US011235598B2

(12) United States Patent
Satoh et al.

(10) Patent No.: US 11,235,598 B2
(45) Date of Patent: Feb. 1, 2022

(54) APPARATUS, INLET AIR UNIT AND LIQUID DISCHARGING APPARATUS

(71) Applicants: Toshiya Satoh, Kanagawa (JP); Teiichiro Ishikawa, Tokyo (JP); Masaya Hamaguchi, Kanagawa (JP); Yusuke Komine, Kanagawa (JP); Huizee Then, Kanagawa (JP); Naohiro Toda, Kanagawa (JP); Hidehisa Shibasaki, Ibaraki (JP)

(72) Inventors: Toshiya Satoh, Kanagawa (JP); Teiichiro Ishikawa, Tokyo (JP); Masaya Hamaguchi, Kanagawa (JP); Yusuke Komine, Kanagawa (JP); Huizee Then, Kanagawa (JP); Naohiro Toda, Kanagawa (JP); Hidehisa Shibasaki, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/804,235

(22) Filed: Feb. 28, 2020

(65) Prior Publication Data

US 2020/0276839 A1 Sep. 3, 2020

(30) Foreign Application Priority Data

Mar. 1, 2019 (JP) ..... JP2019-037949
Feb. 19, 2020 (JP) ..... JP2020-026566

(51) Int. Cl.
*B41J 13/00* (2006.01)

(52) U.S. Cl.
CPC ..... *B41J 13/0009* (2013.01)

(58) Field of Classification Search
CPC ..... B05C 1/083; B41F 23/0479
See application file for complete search history.

(56) References Cited

U.S. PATENT DOCUMENTS 4,263,724 A * 4/1981 Vits ..... B41F 23/0479 118/67
4,852,492 A 8/1989 Pfizenmaier
5,515,619 A 5/1996 Kahl et al.
6,328,852 B1 12/2001 McGary et al.
(Continued)

FOREIGN PATENT DOCUMENTS

AT 506408 9/2009
EP 0245634 11/1987
(Continued)

OTHER PUBLICATIONS

Extended European Search Report for 20160104.4 dated Jul. 7, 2020.

*Primary Examiner* — Lam S Nguyen
(74) *Attorney, Agent, or Firm* — IPUSA, PLLC

(57) ABSTRACT

An apparatus according to one aspect of the present disclosure includes a temperature controlling member configured to heat or cool a conveyed substrate to which a liquid is applied, the conveyed substrate contacting an outer peripheral surface of the temperature controlling member; and an upstream inlet air unit configured to draw air between the substrate and the temperature controlling member, the upstream inlet air unit being provided upstream of a contact location of the substrate with the temperature controlling member, in a conveying direction.

13 Claims, 22 Drawing Sheets

(56) References Cited

U.S. PATENT DOCUMENTS

| | | | | |
|---|---|---|---|---|
| 6,613,386 | B1 * | 9/2003 | Kustermann | B05C 1/083 118/249 |
| 9,550,376 | B2 | 1/2017 | Yamada et al. | |
| 10,384,472 | B2 | 8/2019 | Onodera et al. | |
| 2009/0110804 | A1 | 4/2009 | Ogawa et al. | |
| 2009/0308556 | A1 | 12/2009 | Gissing et al. | |
| 2019/0283459 | A1 | 9/2019 | Nakamura et al. | |
| 2019/0299692 | A1 | 10/2019 | Toda et al. | |

FOREIGN PATENT DOCUMENTS

| | | |
|---|---|---|
| EP | 0812685 | 12/1997 |
| EP | 3421251 | 1/2019 |
| JP | H10-052905 | 2/1998 |
| JP | 2007-322867 | 12/2007 |
| JP | 2014-152964 | 8/2014 |
| JP | 2014-238191 | 12/2014 |
| JP | 2016-087925 | 5/2016 |
| JP | 2018-066552 | 4/2018 |
| JP | 2019-162870 | 9/2019 |
| JP | 2019-177553 | 10/2019 |
| JP | 2019-178815 | 10/2019 |
| WO | 82/02938 | 9/1982 |

* cited by examiner

APPARATUS, INLET AIR UNIT AND LIQUID DISCHARGING APPARATUS

CROSS-REFERENCE TO RELATED APPLICATION

The present application claims priority under 35 U.S.C. § 119 to Japanese Patent Application Nos. 2019-37949, filed Mar. 1, 2019, and 2020-26566, filed Feb. 19, 2020, the contents of which are incorporated herein by reference in their entirety.

BACKGROUND OF THE INVENTION

1. Field of the Invention

The present disclosure relates to an apparatus, an inlet air unit, and a liquid discharging apparatus.

2. Description of the Related Art

Liquid discharge apparatuses such as printing devices employing a liquid discharge system are widely used. In recent years, such a liquid discharge apparatus has been commercially used in printing on a substrate used for posters or food packaging, or the like.

For the liquid discharging apparatus, there are cases of decreasing productivity by printing, due to difficulty in drying a liquid on a substrate. In this regard, in order to facilitate drying, a heating device is disclosed to include a heating drum that heats a substrate, which contacts an outer peripheral surface of the heating drum and to which a liquid is applied, to convey the substrate along a conveyance path formed on the outer peripheral surface of the heating drum (e.g., Japanese Unexamined Patent Application Publication No. 2018-66552 which is hereinafter referred to as Patent Document 1).

SUMMARY

According to one aspect of the present disclosure, an apparatus includes: a temperature controlling member configured to heat or cool a conveyed substrate to which a liquid is applied, the conveyed substrate contacting an outer peripheral surface of the temperature controlling member; and an upstream inlet air unit configured to draw air between the substrate and the temperature controlling member, the upstream inlet air unit being provided upstream of a contact location of the substrate with the temperature controlling member, in a conveying direction.

DETAILED DESCRIPTION OF THE EMBODIMENTS

Figure 1:
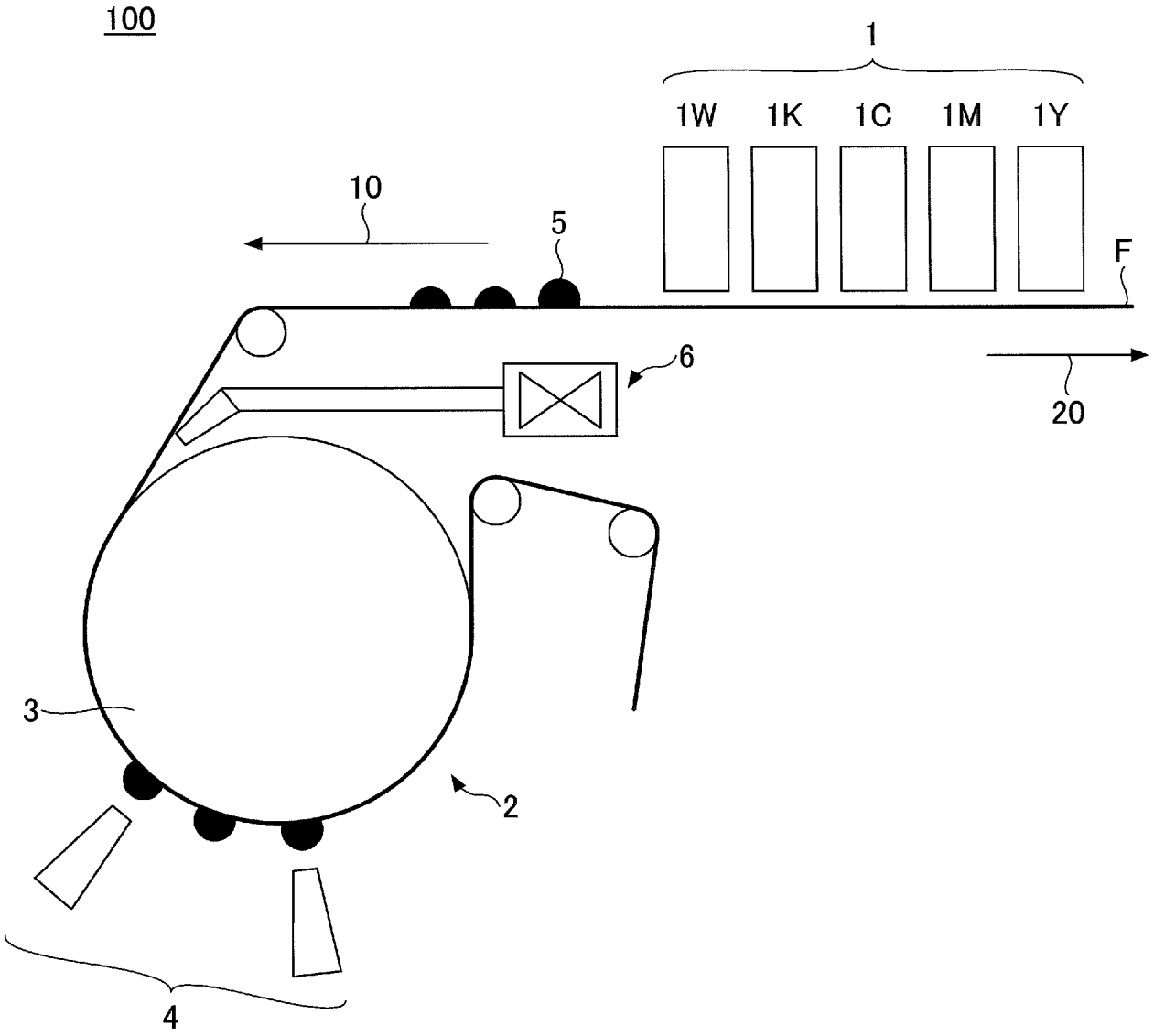
FIG. 1 is a diagram illustrating an example of a configuration of an image forming apparatus according to a first embodiment.

One or more embodiments provide an apparatus or the like to avoid reductions in the adhesion of a substrate to a temperature controlling member.

One or more embodiments will be hereinafter described with reference to the drawings. In each figure, the same reference numerals are used to denote the same components; accordingly, the duplicate explanation for the components may be omitted.

The terms "image formation", "recording", "printing", "imprinting", "print", and "3D printing" used in one or more embodiments are interchangeably used in the embodiments.

In one or more embodiments, "an apparatus for discharging a liquid" is an apparatus with a liquid discharging head or a liquid discharging unit, the liquid discharging head or the liquid discharging unit being driven to discharge a liquid. Note that "an apparatus for discharging a liquid" and "a liquid discharging apparatus" are interchangeably used in one or more embodiments.

The "apparatus for discharging a liquid" can include a mechanism relating to feeding, conveying, and ejecting of a substrate to which a liquid can adhere, as well as including a pre-processing device, a post-processing device, and the like.

For example, the "apparatus for discharging a liquid" includes an apparatus such as an image forming apparatus in which a liquid such as ink is discharged to form an image on paper.

The "substrate to which a liquid can adhere" includes a substrate to which a liquid can temporarily adhere, or the like. Where, the adhering liquid is fixed to the substrate, or the adhering liquid penetrates into the substrate.

The "liquid" is not particularly restricted. The liquid has viscosity or surface tension, the viscosity allowing the liquid to be discharged from a head. Preferably, a liquid has viscosity of 30 mPa·s or less, at ordinary temperature and under ordinary pressure; or when the liquid is heated or cooled. More specifically, a liquid includes a solvent; suspension; an emulsion; or the like. Each of the solvent, the suspension, and the emulsion includes a solvent such as water or an organic solvent; a colorant such as a dye or pigment; a polymerizable compound; resin; a material to which functionality is added, such as a surfactant; a biocompatible material such as DNA, an amino acid, or a protein, calcium; an edible material such as a natural colorant. For example, the solvent, the suspension, or the emulsion can be taken as an inkjet ink; a liquid used in surface treatment; a liquid used in forming a component such as an electronic element or a light emitting element; a liquid used in forming a resist pattern for an electronic circuit; a material liquid used in forming a 3D image; or the like.

The "apparatus for discharging a liquid" includes an apparatus in which a liquid discharging head and a substrate to which a liquid can adhere move relatively, but is not limited to this example. Specific examples of the "apparatus for discharging a liquid" include a serial type apparatus that causes a liquid discharging head to move; a line type apparatus in which a liquid discharging head is not moved; and the like.

The "liquid discharging unit" is a unit in which at least one from among one or more functional components and one or more mechanisms is integrated with a liquid discharging head. The "liquid discharging unit" means a group of components relating to discharging of a liquid. For example, the "liquid discharging unit" includes a combination, etc. of a liquid discharging head and at least one from among a head tank; a carriage; a supplying mechanism; a maintenance-and-recovery mechanism; and a main scanning-moving mechanism.

For example, "integration" covers a case where a liquid discharging head is fixed to at least one from among one or more functional components and one or more mechanisms, by fastenings, bonding, engaging elements, or the like. Further, "integration" covers a case where a liquid discharging head is movably retained with respect to at least one from among one or more functional components and one or more mechanisms, as well as covering a case where at least one from among one or more functional components and one or more mechanisms is movably retained with respect to a liquid discharging head. A liquid discharging head may be detached. Further, a liquid discharging head may be detached from a given functional component or a given mechanism.

For example, as a liquid discharging unit, a unit in which a liquid discharging head and a head tank are integrated may be used. A liquid discharging unit in which a liquid discharging head and a head tank are integrally connected with a tube or the like may be also used. For each of the above liquid discharging units, a filter can be added between a head tank and a liquid discharging unit.

As a liquid discharging unit, a unit in which a liquid discharging head and a carriage are integrated may be used.

As a liquid discharging unit, a unit in which a liquid discharging head and a main scanning-moving mechanism are integrated may be used, where the liquid discharging head is movably retained by a guide member that constitutes part of the main scanning-moving mechanism. Further, a liquid discharging unit in which a liquid discharging head, a carriage, and a main scanning-moving mechanism are integrated may be used.

As a liquid discharging unit, a unit in which a liquid discharging head, a carriage, and a maintenance-and-recovery mechanism are integrated may be used, where a cap member that constitutes part of the maintenance-and-recovery mechanism is fixed to the carriage to which the liquid discharging head is attached.

As a liquid discharging unit, a unit in which a liquid discharging head and a supplying mechanism are integrated may be used, where a tube is connected with the liquid discharging head to which a head tank or a flow path component is attached. A liquid in a liquid storage is supplied to the liquid discharging head through the tube.

The main scanning-moving mechanism also includes a single guide member. The supplying mechanism also includes a single tube and a single loading unit.

The "liquid discharging head" refers to a functional component that discharges a liquid from one or more nozzles, and that ejects the liquid from the nozzles.

An energy source that allows for discharge of a liquid includes a piezoelectric actuator (a laminated piezoelectric element and a thin-film piezoelectric element); a thermal actuator using an electric thermal conversion element such as a heating resistor; an electrostatic actuator with a vibration plate and opposite electrodes; or the like.

In the following description, one or more embodiments will be described using an inkjet image forming apparatus as an example of "an apparatus for discharging a liquid". Where, a film is used as a "substrate to which a liquid can adhere", and ink is used as a "liquid". Note that a film is used for food packaging or the like, and is a thin film made of plastic such as polyethylene terephthalate.

The film is an example of a "substrate". However, the substrate is not limited to the film, and as the "substrate", a recording medium such as coated paper or plain paper may be used.

First Embodiment

<Configuration of Image Forming Apparatus According to First Embodiment>

An image forming apparatus according to a first embodiment will be described. FIG. 1 is a diagram illustrating an example of a configuration of the image forming apparatus according to the present embodiment.

As illustrated in FIG. 1, an image forming apparatus 100 includes an ink discharging unit 1 and a drying unit 2. With respect to the image forming apparatus 100, a film F is fed by a feeding unit and is conveyed along a conveyance direction 10, by a conveying unit. In this case, tension is applied in a direction indicated by an arrow 20, by the feeding unit, to ensure conveyance accuracy. Note that the feeding unit and the conveying unit are not illustrated in FIG. 1.

The image forming apparatus 100 discharges ink into a conveyed film F, through an ink discharging unit 1, and applies ink to a surface of the film F to form an image. In FIG. 1, ink 5 indicates ink applied to the surface of the film F.

The film F is a continuous film capable of being rolled. For example, a film made of oriented polypropylene (OPP) and used in soft packaging such as food packaging is used as the film F.

Ink discharged by the ink discharging unit 1 is an aqueous ink, for example. The aqueous ink basically contains a solvent and a colorant, and water is mainly used as the solvent.

The ink discharging unit 1 includes an ink discharging head 1W for white; an ink discharging head 1K for black; an ink discharging head 1C for cyan; an ink discharging head 1M for magenta; and an ink discharging head 1Y for yellow.

The ink discharging head 1W discharges a white (W) ink, and the ink discharging head 1K discharges a black (K) ink. The ink discharging heads 1W and 1K apply respective inks to a surface of a film F. Further, the ink discharging head 1C discharges a cyan (C) ink, the ink discharging head 1M discharges a magenta (M) ink, and the ink discharging head 1Y discharges a yellow (Y) ink. The ink discharging head 1C, 1M, and 1Y apply respective inks to a surface of a film F. Each of the ink discharging heads 1W, 1K, 1C, 1M, and 1Y is an example of a "liquid applying unit".

One or more embodiments will be described using the image forming apparatus 100 with ink discharge heads for five colors of white (W), black (K), cyan (C), magenta (M), and yellow (Y). However, the image forming apparatus 100 is not limited to the example described above. The image forming apparatus 100 may further include at least one ink discharging head for a corresponding color from among green (G), red (R), light cyan (LC), or other colors.

Alternately, the image forming apparatus 100 may include only a single ink discharging head 1K for black.

The drying unit 2 as an example of an "apparatus," includes a temperature controlling member 3; a air generating unit 4; and a first contact-side inlet air unit 6. The drying unit 2 dries the ink 5 applied to a surface of the film F.

The temperature controlling member 3 is a rotatable cylindrical member. The temperature controlling member 3, of which an outer peripheral surface contacts a film F surface (hereinafter referred to as a back surface) opposite to a film F surface to which a liquid is applied, rotates to convey the film F along a conveyance direction 10.

The inside of the temperature controlling member 3 is filled with hot water that is maintained at a predetermined temperature. The temperature controlling member 3 transfers the heat of the hot water to the film F, through the back surface of the film. Thereby, the film F can be maintained at a predetermined temperature. As an example, the predetermined temperature may be 70 degrees C.

The air generating unit 4 blows air generated and heated by a heater or the like, to a film F surface (hereinafter referred to as a front surface) to which a liquid is applied. Thereby, the film is heated and thus the ink temperature is increased. Accordingly, drying can be facilitated. Note that, instead of the air generating unit 4; or in addition to the air generating unit 4, the drying unit 2 may include an infrared heater. In this case, with a front surface of a film F being irradiated with infrared, drying may be facilitated.

In the present embodiment, heat is transferred to the back surface of the film F through the temperature controlling member 3, and the front surface of the film F is heated by the air generating unit 4. In this case, the temperature of the whole film F in a thickness direction changes depending on a temperature of the temperature controlling member 3 having a large heat capacity.

As an example, when the temperature of hot water inside the temperature controlling member 3 was 70 degrees C.; and the temperature of the air blown by the air generating unit 4 was 300 degrees C., the temperature of the back surface of a given film F was 85 degrees C.; and the temperature of ink on the front surface of the film F was 150 degrees C. In light of the result, the air generating unit 4 can heat ink on the front surface of a given film F to a temperature of 100 degrees C. or more, which is the boiling point of aqueous inks, as well as the temperature controlling member 3 being able to cause a given film F to be at temperatures of 100 degrees C. or less, which indicate a general heat-resistant temperature. Thereby, thermal losses in the film F may be reduced, thereby facilitating the drying of the ink.

Note that, in the present embodiment, an example in which hot water is circulated through the temperature controlling member 3 is described. However, the temperature controlling member 3 can circulate coolant water at a lower temperature, to thereby cool a substrate such as a film F.

The first contact side-inlet air unit 6 draws air between a film F and the temperature controlling member 3, upstream of a point (hereinafter referred to as a first contact point) at which the conveyed film F first contacts the temperature controlling member 3, in a conveyance direction. The first contact side-inlet air unit 6 will be described below in detail with reference to FIG. 7.

Figure 2:
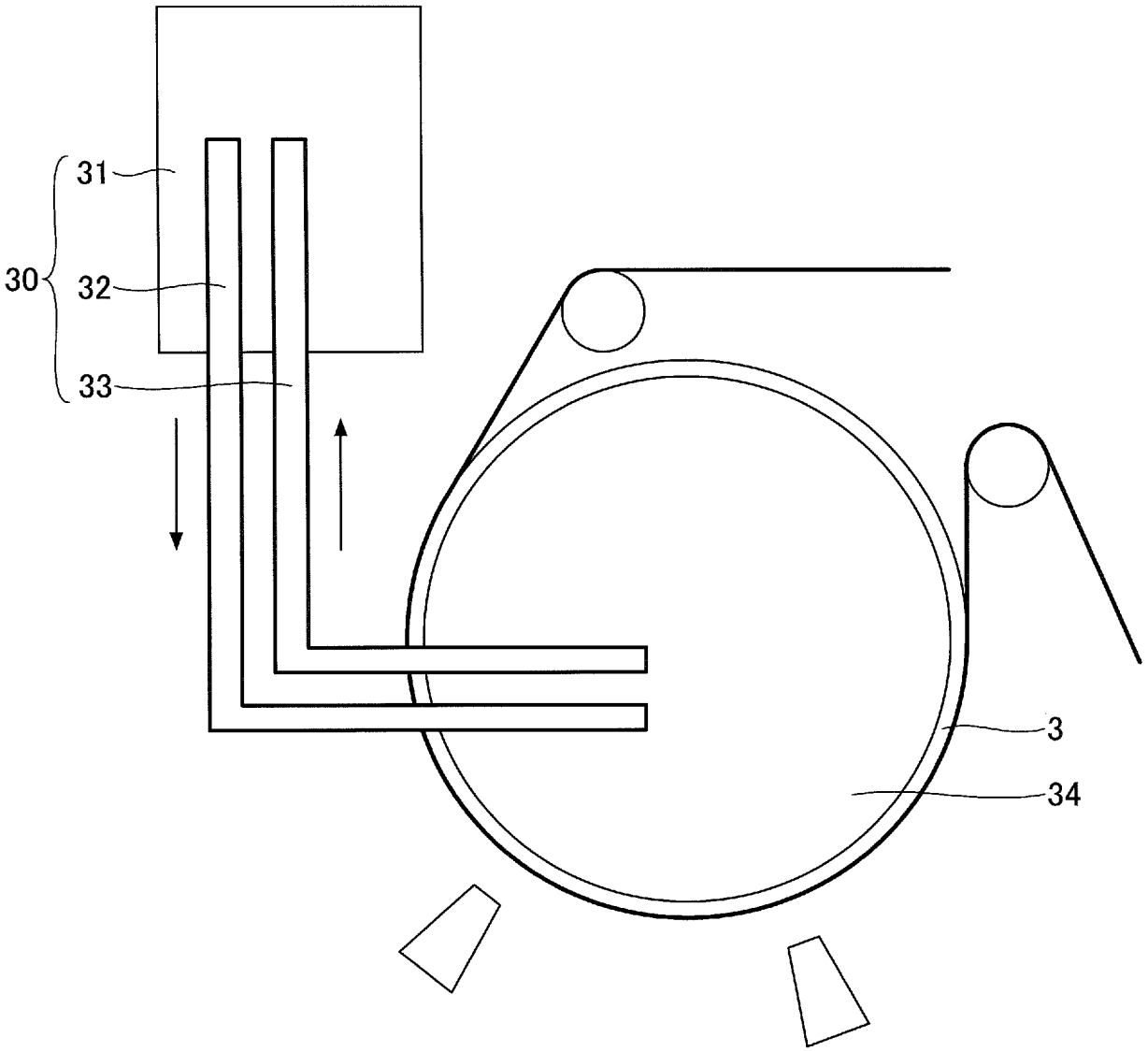
FIG. 2 is a diagram illustrating an example of a configuration of a hot-water temperature maintaining mechanism.

FIG. 2 is a diagram illustrating an example of a configuration of a hot water-temperature maintaining mechanism for maintaining a predetermined temperature of hot water within the temperature controlling member 3. As illustrated in FIG. 2, the hot water-temperature maintaining mechanism 30 includes a chiller 31, an inlet hose 32, and an outlet hose 33. The hot water-temperature maintaining mechanism circulates hot water filled inside the temperature controlling member 3 to maintain a constant temperature of hot water.

More specifically, the chiller 31 can supply hot water to the inside of the temperature controlling member 3, through the inlet hose 32, where the hot water is controlled to a predetermined temperature by heat exchange. Further, the chiller 31 can withdraw hot water from the inside of the temperature controlling member 3, through the outlet hose 33, to maintain a predetermined temperature of the withdrawn hot water by heat exchange. Such a temperature control by the chiller 31 can be achieved by a known technique; accordingly, explanation for the temperature control will not be provided in more detail in this description.

Hereafter, the withdrawal of air into the space between the temperature controlling member 3 and the film F will be described with reference to FIG. 3.

When the conveying speed at which the film F is conveyed is increased, the air flow increases in accordance with movement of the temperature controlling member 3 and the film F. Further, as illustrated in FIG. 3, the flow 7 of air being drawn into the space between the film F and the temperature controlling member 3 is increased upstream of a first contact point 3*a* in the conveyance direction. As a result, air enters between the film F and the temperature controlling member 3, and is easily interposed between the temperature controlling member 3 and the film F that partially contacts the temperature controlling member 3, where the film F is wrapped around the temperature controlling member 3.

Figure 3:
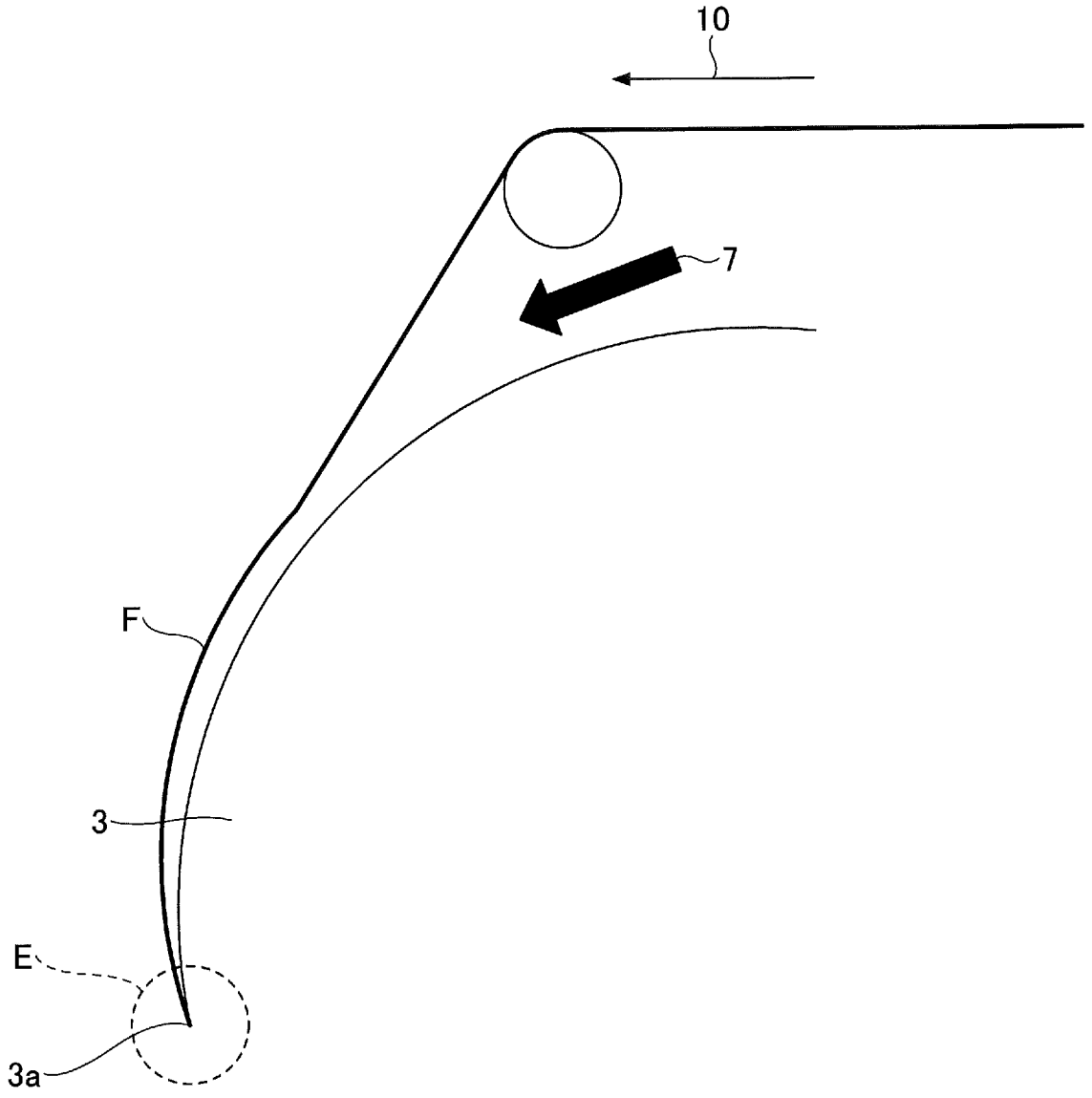
FIG. 3 is a diagram illustrating an example of air being withdrawn into a space between a temperature controlling member and a film.
Figure 4:
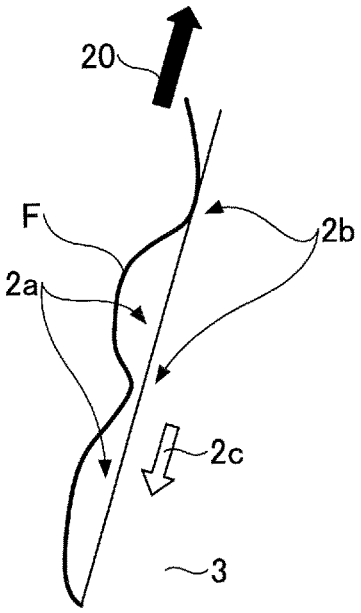
FIG. 4 is a diagram illustrating a state of air being interposed between a temperature controlling member and a film.

FIG. 4 is a partially enlarged view of the portion E surrounded by the dashed line in FIG. 3. FIG. 4 is a diagram illustrating a state in which air is interposed between the temperature controlling member and the film. In FIG. 4, the 2*a* indicates air interposed between the film F and the temperature controlling member 3. In a portion where the air 2*a* is interposed between the film F and the temperature controlling member 3, the film F does not contact the temperature controlling member 3.

The heat from the temperature controlling member 3 is mainly transferred through contact portions 2*b* of the film F with the temperature controlling member 3. The quantity of heat transferred from a non-contact portion of the film F with the temperature controlling member 3 becomes extremely small. In such a manner, when air interposed between the film F and the temperature controlling member 3 increases and thus the area of the non-contact portion increases, the quantity of heat transferred from the temperature controlling member 3 to the film F might be reduced. Accordingly, drying efficiency might be decreased.

In the present embodiment, as described above, in order to facilitate drying, the air is blown from the air generating unit 4 to the front surface of the film F, whose back surface contacts the outer peripheral surface of the temperature controlling member 3. In such a configuration, when the temperature of the air from the air generating unit 4 is higher than the temperature of the outer peripheral surface of the temperature controlling member 3, a cooling effect on the air through the temperature controlling member 3 is reduced in a non-contact portion of the film F with the temperature controlling member 3. As a result, the temperature of the whole film F in the thickness direction is close to the temperature of the air. For example, when the temperature of the air is higher than the softening point of the film F, the film F may be thermally deformed, which may result in wrinkles in the film F.

Further, in the portion of the film F that contacts the temperature controlling member 3, a static friction force is applied in the direction indicated by an arrow 2*c*. Even when tension is applied in the direction indicated by the arrow 20, from a feeding unit, tensile stress on the film F is reduced because the above static frictional force is applied as a reactive force. However, when air interposed between the film F and the temperature controlling member 3 is increased and thus an area of a non-contact portion of the film F with the temperature controlling member 3 is increased, reductions in the tensile stress on the film F are minimized because the static frictional force is reduced. As a result, in a state in which heat is transferred to the film F through the air from the air generating unit 4, tensile stress is greatly applied. Thereby, the film F may be more easily deformed due to synergistic stress acting by a heat quantity and tensile stress.

As an example, when the film F was conveyed at a conveying speed of 2 mpm (meter per minute), in a case where the air at a temperature of 300 degrees C. was blown to the film F by the air generating unit 4, the film F was not deformed. However, when the conveying speed was increased to 32 mpm, wrinkles appeared in the film F. In order to prevent wrinkles from appearing, the temperature of the air was decreased to 180 degrees C. Under such a condition, drying efficiency of ink was decreased because a temperature of the air was decreased.

Figure 5:
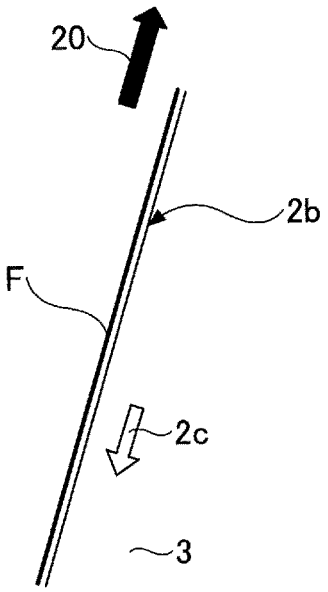
FIG. 5 is a diagram illustrating a state of air not being interposed between a temperature controlling member and a film.

FIG. 5 is a partially enlarged view of a portion E surrounded by a dashed line in FIG. 3. FIG. 5 is a diagram illustrating a state in which air is not interposed between the temperature controlling member and the film. In this example, because air is not interposed between the temperature controlling member 3 and the film F, the area of the contact portion 2*b* of the film F with the temperature controlling member 3 is increased. Thereby, more heat is transferred from the temperature controlling member 3 to the film. Accordingly, drying efficiency is improved.

Further, because the area of the contact portion of the film F with the temperature controlling member 3 is increased, a cooling effect on the air through the temperature controlling member 3 can be reliably provided in a non-contact portion of the film F with the temperature controlling member 3. As a result, the temperature in the whole film F in a thickness direction can come closer to a temperature of the temperature controlling member 3. Accordingly, wrinkles in a given film F can be reduced.

Additionally, in accordance with the contact area of the film F with the temperature controlling member 3 being increased, the static friction force applied in a direction indicated by the arrow 2*c* is also increased. Thus, because the static friction force is applied as a reactive force, tensile stress on the film F is reduced. Thereby, deformation of the film F can be prevented by synergistic stress acting by a heat quantity and the tensile stress.

Figure 6:
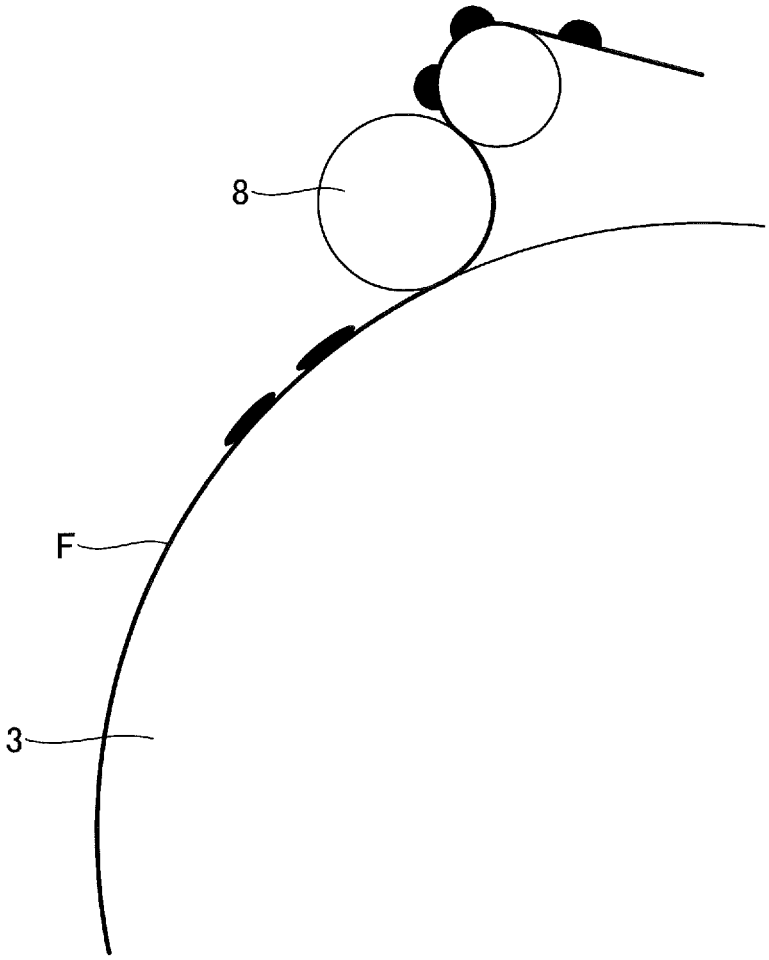
FIG. 6 is a diagram illustrating a method of preventing air from being withdrawn according to a comparative example.

FIG. 6 is a diagram illustrating a method of preventing air from being withdrawn according to a comparative example. In FIG. 6, a sponge roller 8 is disposed upstream of a first contact point in the conveyance direction. When the film F is pressed against the sponge roller 8, air between the temperature controlling member 3 and the film F is pressed. Thereby, air is prevented from being withdrawn and thus air can be prevented from being interposed between the temperature controlling member 3 and a film F. However, in such a configuration, because a film F surface to which ink is applied contacts the sponge roller 8, ink contacts the sponge roller 8, before drying. Accordingly, an image on a given film F may be unsuccessfully formed.

Figure 7:
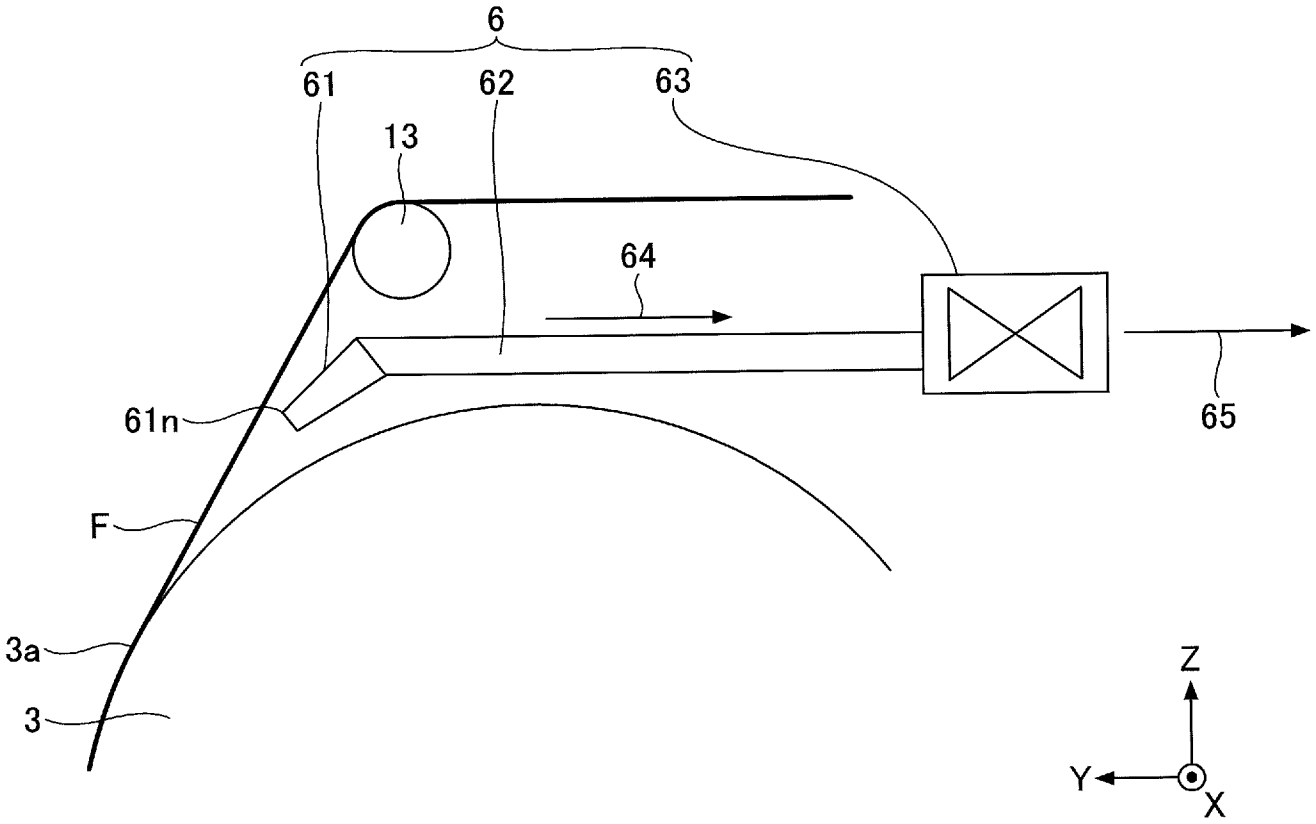
FIG. 7 is a partially enlarged view of an example of a configuration of a first contact side-inlet air unit.

In light of the issue described above, according to the present embodiment, the image forming apparatus 100 includes a first contact side-inlet air unit 6. FIG. 7 is a partially enlarged view of an example of a configuration of a first contact side-inlet air unit. The first contact side-inlet air unit 6 is an example of an "upstream inlet air unit". In FIG. 7, an X direction indicated by an arrow in FIG. 7 is perpendicular to a Y direction being a conveying direction in which a film F is conveyed. The X direction is hereafter referred to as a width direction. A Z direction is perpendicular to both of the X direction and the Y direction.

As illustrated in FIG. 7, the first contact side-inlet air unit 6 includes a nozzle 61, a tube 62, and a blower 63.

The nozzle 61 includes an inlet port 61*n* for drawing air. The inlet port 61*n* is disposed upstream of a first contact location 3*a* in the conveyance direction, to face the first contact point 3*a*. The nozzle 61 is disposed between a conveying roller 13 and the first contact point 3*a*, the conveying roller 13 being disposed upstream of the first contact point 3*a* and in proximity to the nozzle 61. The conveying roller 13 is an example of an "upstream support member". Preferably, the length (width) of the inlet port 61*n* in the width direction is greater than or equal to the width of the film F. In such a manner, air can be drawn over the entire width of the first contact point 3*a*.

The first contact point 3*a* is an example of a "contact location". More specifically, the "contact location" means a contact area covering from the first contact point 3*a* in which the film F first contacts the temperature controlling member 3, to the last contact point in which the film F last contacts the temperature controlling member 3. However, in a case where the temperature controlling member 3 and the film F meet and separate many times, a "contact location" means the area covering from an earliest contacted point of the film F with the temperature controlling member 3, to the latest separated point of the film F from the temperature controlling member 3.

One end of the tube 62 is connected to the end portion that is different from the inlet port 61*n* of the nozzle 61. The other end of the tube 62 is connected to the blower 63. The air drawn by the nozzle 61 travels in the direction indicated by an arrow 64, passes through a hollow tube 62, and then reaches the blower 63.

The blower 63 is an air blower that blows air in a predetermined direction. The blower 63 blows the air in the direction indicated by the arrow 65 to cause an air flow. The blower 63 can generate an attractive force to draw the air from the inlet port 61*n* of the nozzle 61 that is connected via the tube 62.

In such a configuration, the first contact side-inlet air unit 6 draws the air between the film F and the temperature controlling member 3, upstream of the first contact point 3*a* in the conveyance direction. With the first contact side-inlet air unit 6 drawing the air, an amount of air being drawn into a space between the film F and the temperature controlling member 3 is reduced. Thereby, the air interposed between the temperature controlling member 3 and the film F that contacts the temperature controlling member 3 and that is wrapped around the temperature controlling member 3, can be reduced.

<Effect>

Hereafter, an effect of the image forming apparatus according to the present embodiment will be described.

Figure 8:
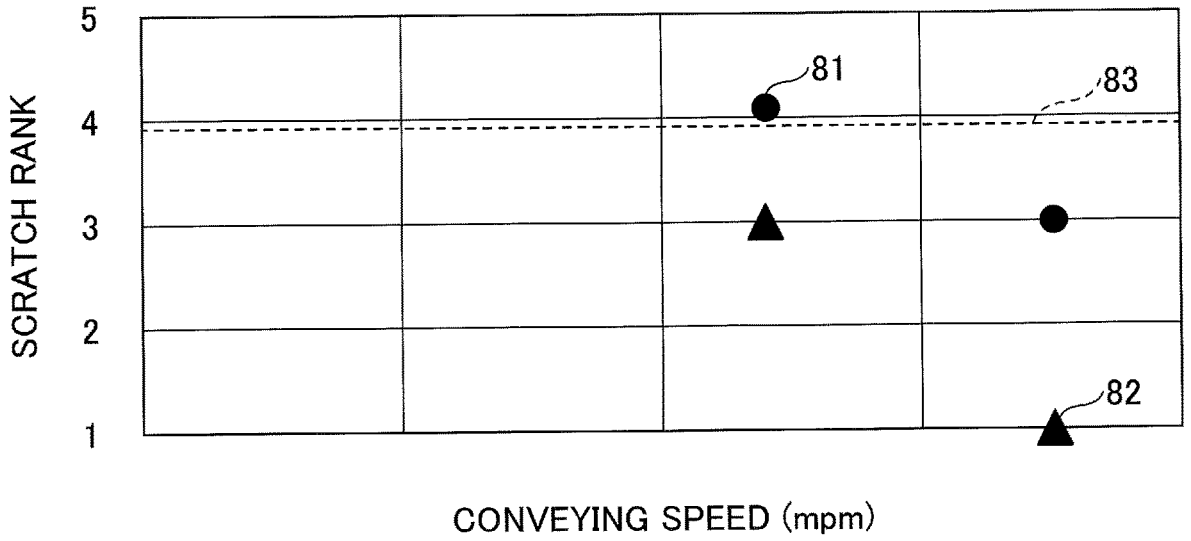
FIG. 8 is a diagram illustrating an example of test results for film scratch.

FIG. 8 is a diagram illustrating an example of test results for scratch of a film used in the image forming apparatus 100. In FIG. 8, a result in a case where air was drawn by the first contact side-inlet air unit 6; and a result in a case where air was not drawn are illustrated.

In FIG. 8, a horizontal axis indicates a conveying speed at which a film F is conveyed. The conveying speed is further increased toward a right side in FIG. 8. A vertical axis in FIG. 8 indicates a scratch rank. Where, scratch means resistance to scratch of ink adhering onto a surface of a film F. The resistance to scratch is increased as a value for a scratch rank increases. In contrast, the resistance to scratch is decreased as a value for a scratch rank decreases. Additionally, the resistance to scratch is increased as ink on a film F is dried. Thus, a drying performance is increased as a value for a scratch rank increases.

A test condition was mainly as follows:

Ink: inkjet aqueous ink (cyan color)

Adhered amount of ink: 3 g/m$^2$

Film: OPP

Film thickness: 20 μm

Temperature of temperature controlling member: 95 degrees C.

Wind speed of air: 20 m/s

Temperature of air: 25 degrees C. (room temperature)

In FIG. 8, round plots 81 indicate test results in the case where air was drawn by a first contact side-inlet air unit 6. Triangular plots 82 indicate test results in the case where air was not drawn by the first contact side-inlet air unit 6. Further, a dashed line 83 indicates an example of a reference line used in determining whether scratch was permitted.

As illustrated in FIG. 8, with respect to each conveying speed, a given round plot 81 indicates a scratch rank higher than a scratch rank expressed by a corresponding triangular plot from among the triangular plots 82. From the results, it has been found that a drying performance in the case where air was drawn by the first contact side-inlet air unit 6 improved in comparison to the case where air was not drawn.

Figure 9A:
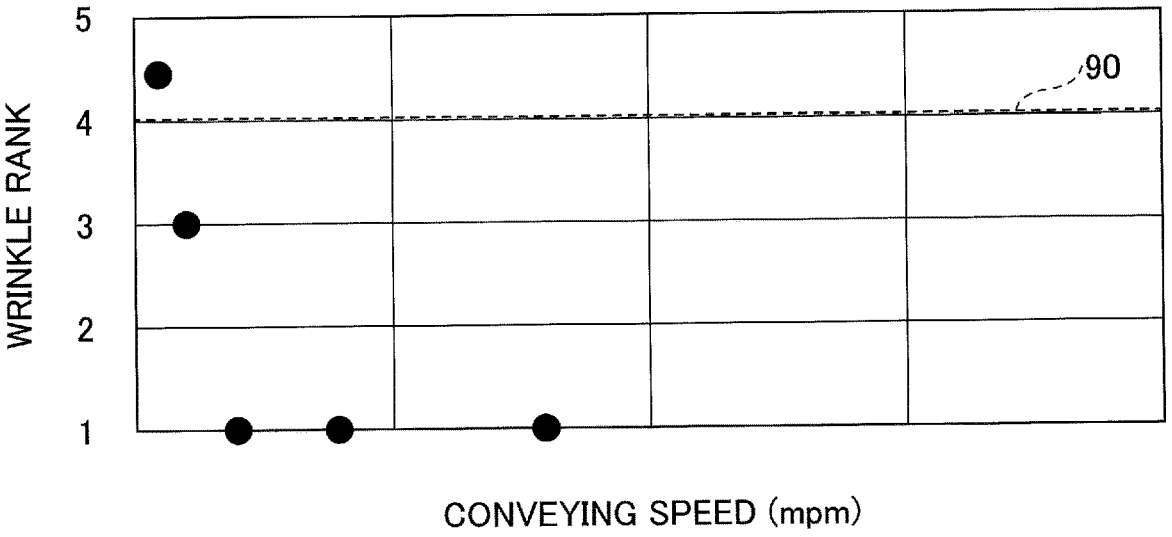
FIG. 9A is a diagram illustrating an example of test results for a film wrinkle in a case where air was not drawn.
Figure 9B:
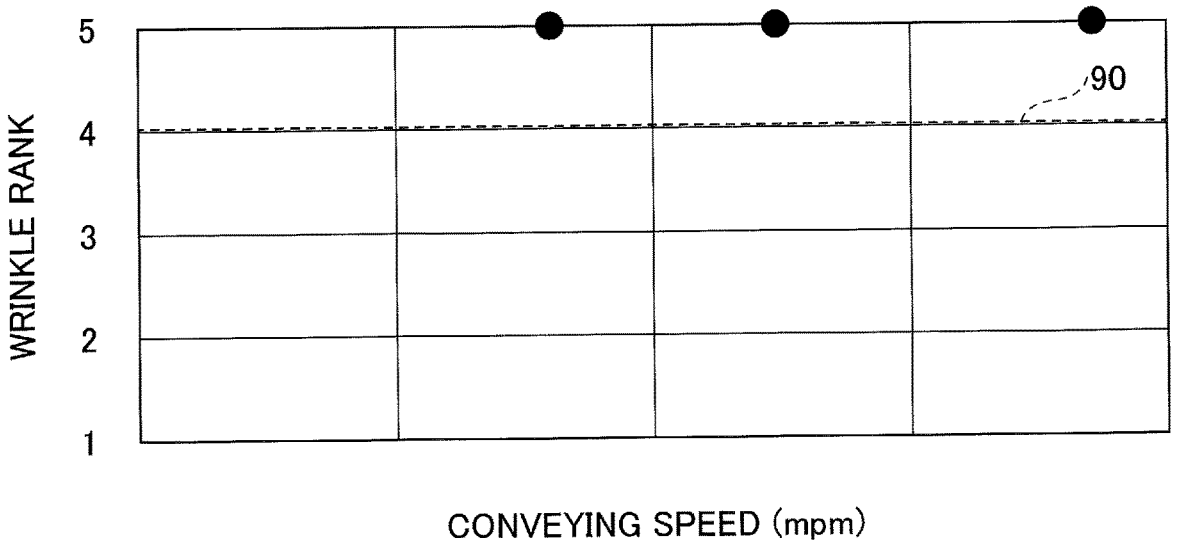
FIG. 9B is a diagram illustrating an example of test results for a film wrinkle in a case where air was drawn.

FIGS. 9A and 9B are diagrams illustrating an example of test results for wrinkles in a film used in the image forming apparatus 100. FIG. 9A illustrates test results in a case where air was not drawn. FIG. 9B illustrates test results in a case where air was drawn.

As is the case with results in FIG. 8, in each of FIGS. 9A and 9B, a horizontal axis indicates a conveying speed of a film F. The conveying speed is further increased toward a right side in each of FIGS. 9A and 9B. Further, a vertical axis indicates a wrinkle rank. A higher wrinkle rank indicates that less wrinkling occurred. In contrast, more wrinkling occurred with a lower wrinkling rank. A dashed line 90 indicates an example of a reference line used in determining whether a wrinkling rank was permitted.

A test condition was mainly as follows:

Temperature of temperature controlling member: 70 degrees C.

Temperature of air: 350 degrees C.

Other conditions were the same as conditions described in FIG. 8.

In the case where air was not drawn, as illustrated in FIG. 9A, a wrinkle rank was decreased (wrinkles was increased) as a conveying speed of a film increased. In contrast, in the case where air was drawn, as illustrated in FIG. 9B, a wrinkle rank was maintained to be increased (wrinkles was decreased), regardless of a conveying speed of a film.

Figure 10:
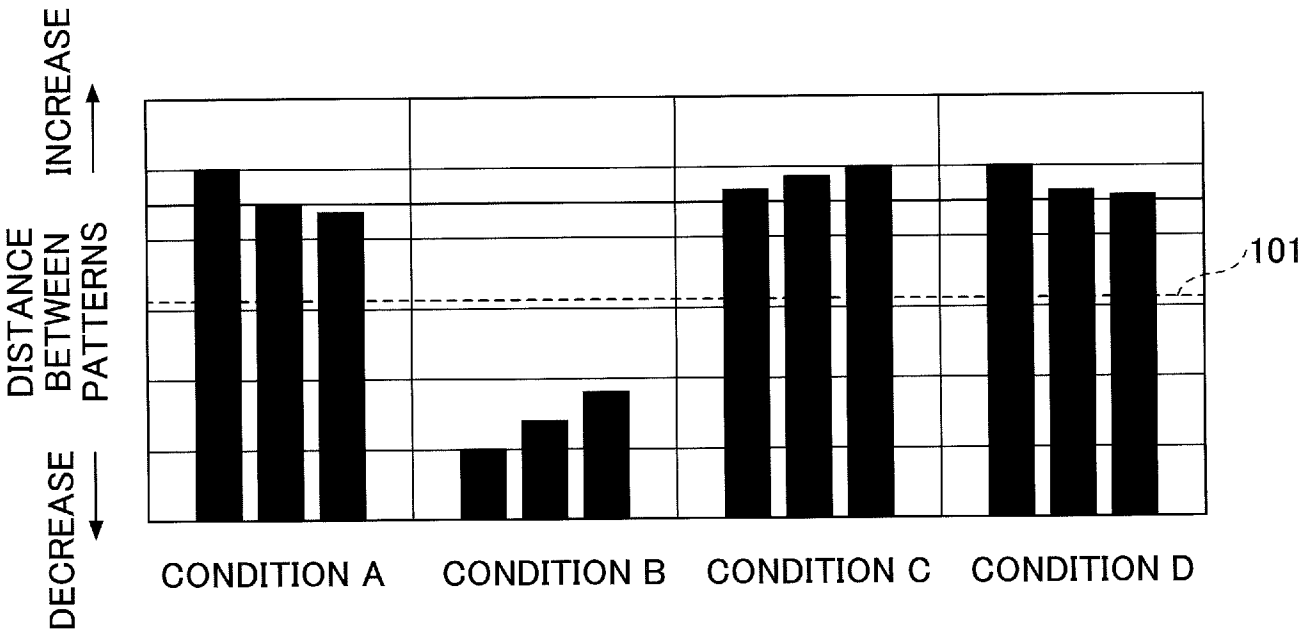
FIG. 10 is a diagram illustrating an example of test results for film shrinkage.

FIG. 10 is a diagram illustrating an example of test results for shrinkage of a film. In FIG. 10, a horizontal axis relates to test conditions A, B, C, and D. For each test condition, three bar graphs are indicated. The three bar graphs illustrate respective results obtained by three tests. A vertical axis indicates a distance between patterns of ink applied to a film F. The shrinkage of a film F is decreased as a distance between patterns increases. In contrast, the shrinkage of a film is increased as a distance between patterns decreases. A dashed line 101 indicates an example of a reference line used in determining whether shrinkage was permitted.

Test conditions A, B, C, and D were as follows:

(Test condition A)

Conveying speed of film: 2 mpm

Drying was not facilitated (temperature control was not performed by a temperature controlling member 3 and air was not blown by a air generating unit 4).

(Test condition B)
Conveying speed of film: 20 mpm
Air was not blown.
Temperature of temperature controlling member: 95 degrees C.
Air was not drawn by a first contact side-inlet air unit 6.
(Test condition C)
Conveying speed of film: 20 mpm
Air was not blown.
Temperature of temperature controlling member: 95 degrees C.
Air was drawn by a first contact side-inlet air unit 6.
(Test conditions D)
Conveying speed of film: 2 mpm
Temperature of air: 250 degrees C. (use of three air nozzles)
Temperature of temperature controlling member: 95 degrees C.
Air was drawn by a first contact side-inlet air unit 6.

As illustrated in FIG. 10, under the test condition A, because drying was not facilitated, a distance between patterns was increased, and shrinkage of a film F was decreased. Under the test condition B in which air was not drawn by the first contact side-inlet air unit 6, a distance between patterns was decreased, and shrinkage of a film F was increased.

Under each of the test condition C and the test condition D, air was drawn by the first contact side-inlet air unit 6. A distance between patterns was increased, and shrinkage of a film F was decreased.

As described above, in the present embodiment, the first contact side-inlet air unit 6 is included to draw air between a film F and a temperature controlling member 3, upstream of a first contact point in a conveyance direction. Thereby, an amount of air being withdrawn into a space between a film F and a temperature controlling member 3 is decreased. Accordingly, adhesion of a film F to the temperature controlling member 3 can be prevented from being reduced due to air being interposed between the film F and the temperature controlling member 3. Further, reductions in drying efficiency; wrinkle generation; film shrinkage; and the like, which are caused by reductions in adhesion, can be avoided.

Second Embodiment

Hereafter, an image forming apparatus according to a second embodiment will be described. Explanation for components that are the same as components described in the above embodiment will be not provided.

<Configuration of Main Part of Image Forming Apparatus According to Second Embodiment>

Figure 11:
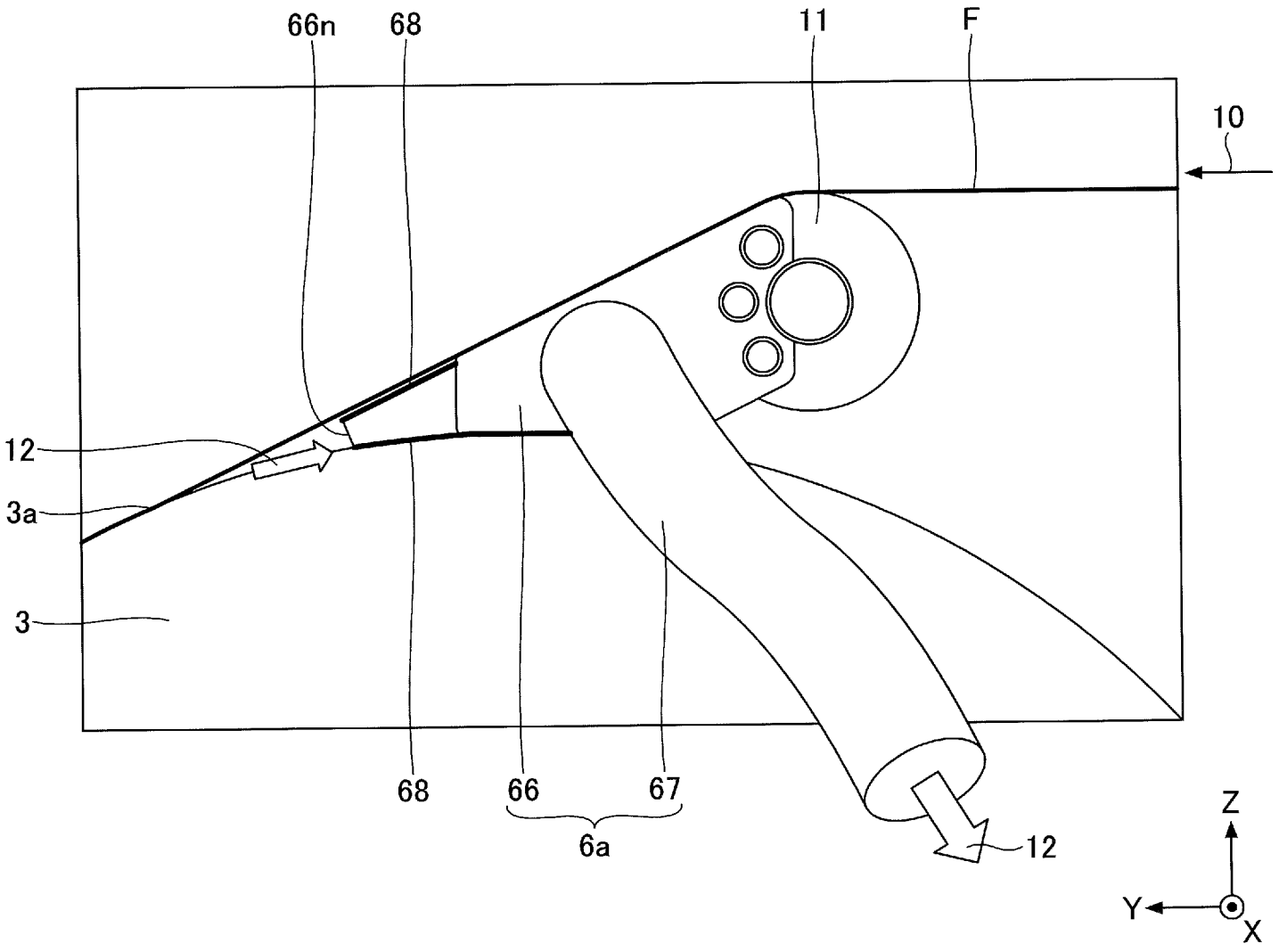
FIG. 11 is a diagram illustrating an example of a configuration of a main part of an image forming apparatus according to a second embodiment.
Figure 12:
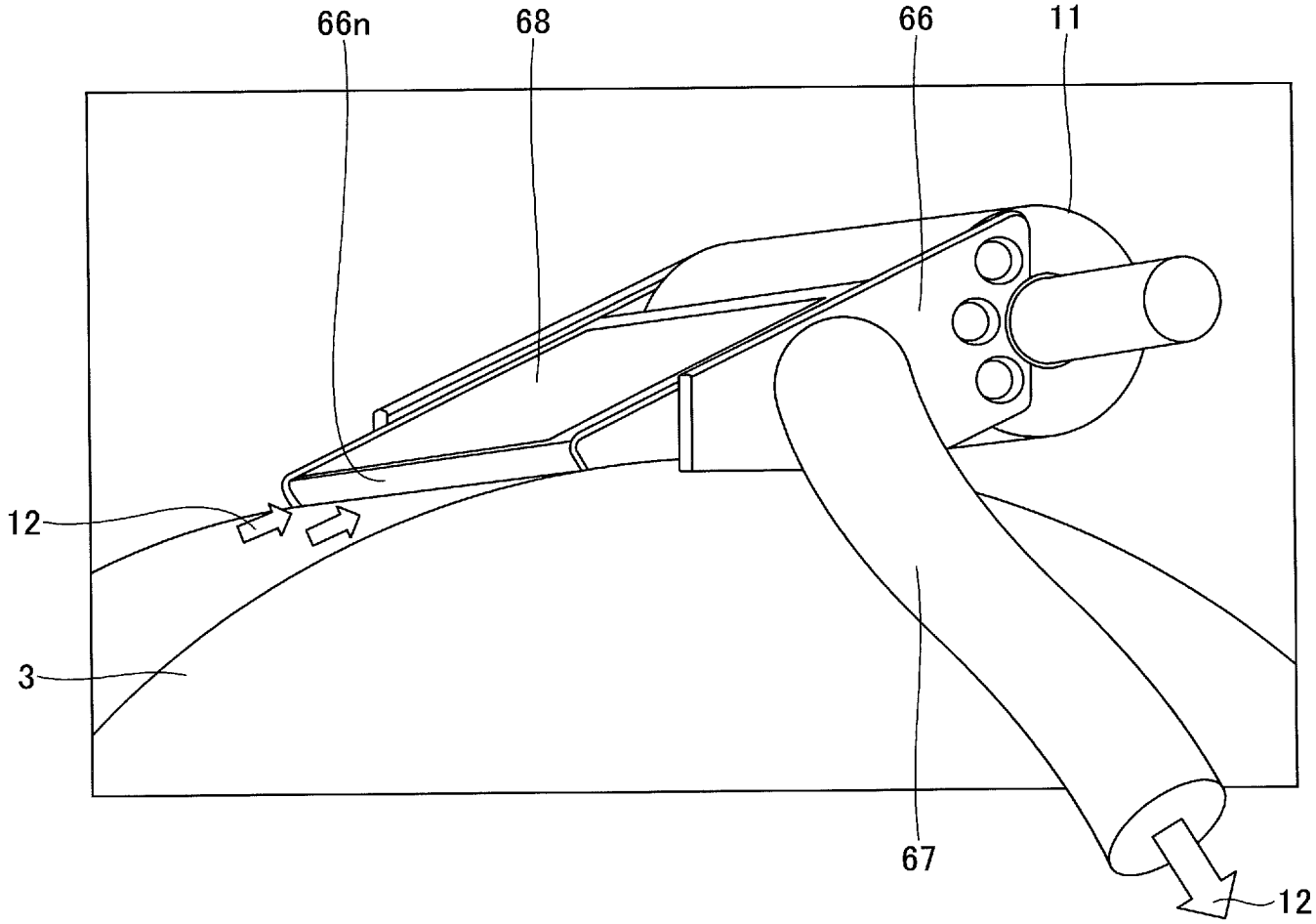
FIG. 12 is a perspective view of an example of the configuration of the main part of the image forming apparatus according to the second embodiment.
Figure 13:
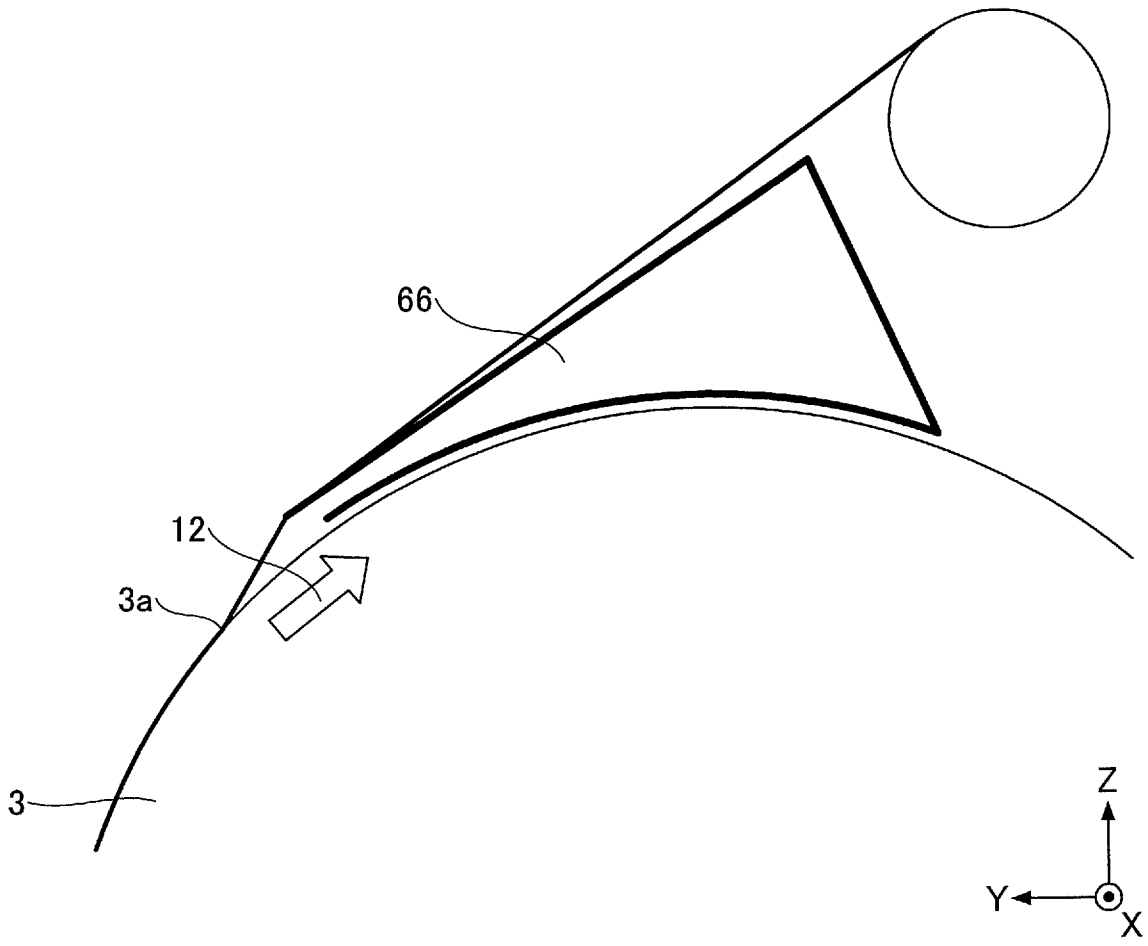
FIG. 13 is a cross-sectional view of an example of the configuration of the main part of the image forming apparatus according to the second embodiment.

A configuration of a main part of an image forming apparatus 100*a* according to the present embodiment will be described with reference to FIGS. 11 through 13. FIG. 11 is a diagram illustrating an example of a configuration of a main part of the image forming apparatus according to the present embodiment. In FIG. 11, for the main part, a configuration in the surroundings of a first contact side-inlet air unit 6*a* is illustrated. FIG. 12 is a perspective view of a configuration in the surroundings of the first contact side-inlet air unit 6*a*. FIG. 13 is a cross-sectional view of a configuration in the surroundings of the first contact side-inlet air unit 6*a*.

In FIG. 11, a film F contacts a conveying roller 11, and then contacts a temperature controlling member 3 to be wrapped around the temperature controlling member 3.

The image forming apparatus 100*a* includes a first contact side-inlet air unit 6*a*, which draws the air between the film F and the temperature controlling member 3, upstream of the first contact point 3*a* in the conveyance direction 3*a*. The first contact side-inlet air unit 6*a* includes an intake duct 66 and a duct hose 67.

The intake duct 66 includes an inlet port 66*n* for drawing air. The inlet port 66*n* is disposed upstream of the first contact point 3*a* in the conveying direction to face the first contact point 3*a*.

A surface of the intake duct 66 toward a positive Z direction is a portion of the outer periphery of the intake duct 66, and contacts a back surface of a conveyed film F, upstream of the first contact point 3*a* in the conveyance direction. Further, a surface of the intake duct 66 toward a negative Z direction is a portion of the outer periphery of the intake duct 66, and contacts the temperature controlling member 3, upstream of the first contact point 3*a* in the conveyance direction. Additionally, side covers are respectively provided on both sides of the intake duct 66 in the X direction. Each side cover extends approximately to a rotational shaft of the conveying roller 11 to cover a space between the film F and the temperature controlling member 3.

As illustrated in FIG. 13, a cross-sectional shape taken along an YZ plane of the intake duct 66 is wedged. The intake duct 66 is located in a space of which a YZ cross-section is wedged, the space being formed upstream of the first contact point 3*a* in the conveyance direction. A distance from the inlet port 66*n* to the first-contact portion 3*a* is preferably 30 mm or less, and more preferably 10 mm or less. With such a distance being set, increases in a space between the film F and the temperature controlling member 3 can be prevented due to the intake duct 66 that is inclined or moved, which is caused by tension of the film F that contacts the intake duct 66.

An opening is provided through a side surface of the intake duct 66 toward the positive X direction (see FIGS. 11 and 12). One end of the duct hose 67 is connected to the opening. The other end of the duct hose 67 is connected to a blower not illustrated. As is the case with the first embodiment, the blower blows air in a predetermined direction, and can thereby generate the attractive force to draw air from the inlet port 66*n* of the intake duct 66.

Arrows 12 indicated in each of FIGS. 11 through 13 express flows of air being drawn from the inlet port 66*n* of the intake air duct 66 and being discharged from the duct hose 67, the flows being caused by the attractive force generated by the blower.

The first contact side-inlet air unit 6*a* includes the intake duct 66. The first contact side-inlet air unit 6*a* draws air between the film F and the temperature controlling member 3, upstream of the first contact point 3*a* in the conveying direction, where a space between the film F and the temperature controlling member 3 is covered by the first contact side-inlet air unit 6*a*.

The intake duct 66 also includes respective contact layers 68 being at a position where the film F contacts the outer periphery of the intake duct; and a position in contact with the temperature controlling member 3 (see FIGS. 11 and 12). A friction coefficient of a given contact layer 68 against a film F is lower than a friction coefficient of the intake duct 66 against a film F. Each contact layer 68 can be formed by applying a tape to the outer periphery of the intake duct 66, the tape being formed of PTFE (polytetrafluoroethylene) having a low friction coefficient. Alternatively, each contact layer 68 can be coated with PTFE.

Figure 14:
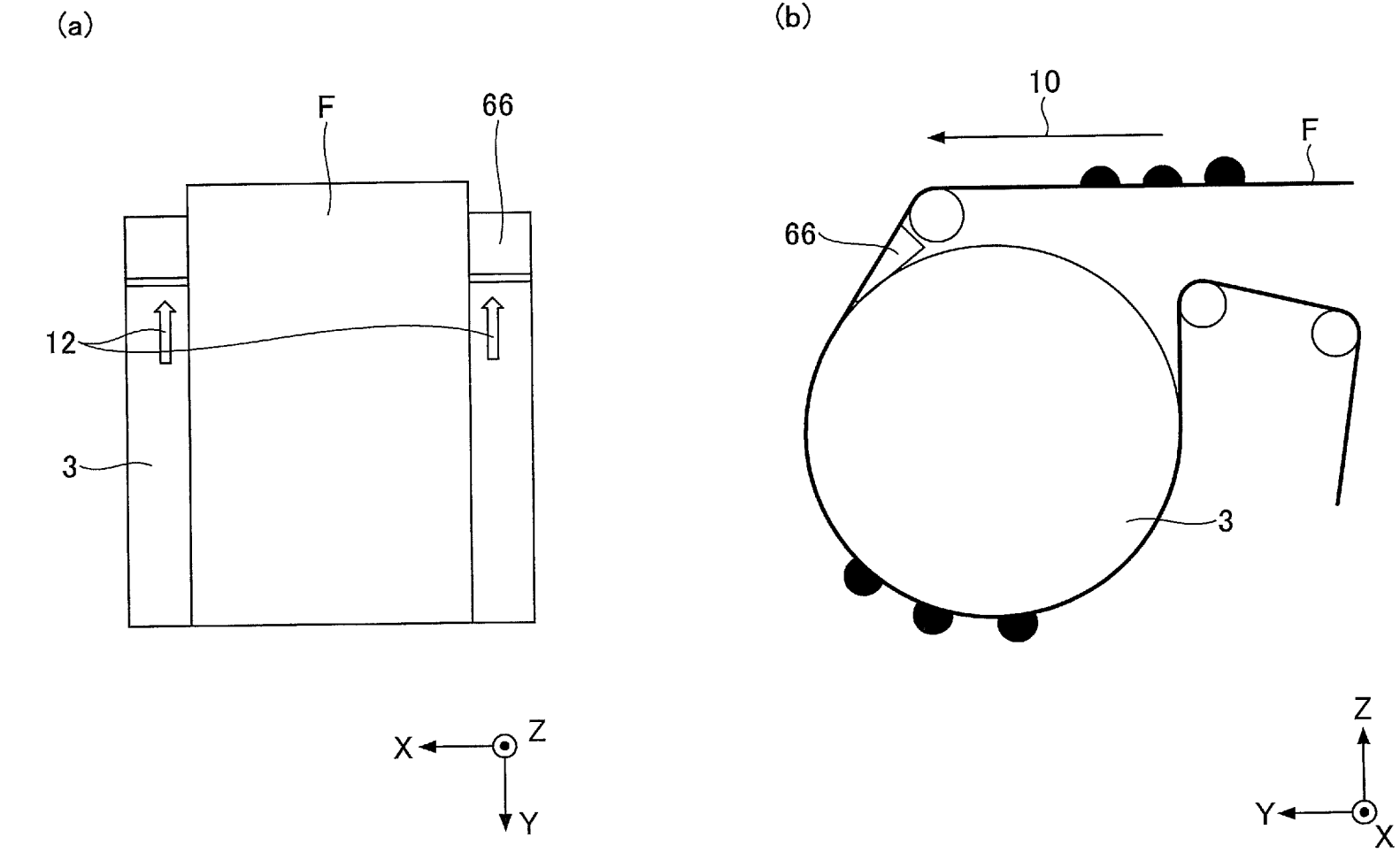
FIG. 14 is a diagram illustrating an example of the configuration of the main part of the image forming apparatus according to the second embodiment, where (a) is a view of the main part when viewed from above the main part; and (b) is a cross-sectional view of the main part.

Further, as illustrated in FIG. 14, the width of the inlet port 66*n* of the intake duct 66 is set to be wider than the film F. FIG. 14(*a*) is a view in the surroundings of a first contact side-inlet air unit 6*a* when viewed from above (a positive Z direction). FIG. 14(*b*) is a YZ cross-sectional view in the surroundings of a first contact side-inlet air unit 6*a*.

<Effect>

In the first embodiment, when an inlet port 61*n* of the first-contact side inlet air unit 6 is not sufficiently close to a first contact point 3*a*, in a case where air in a space between the inlet port 61*n* and the first contact point 3*a* is drawn, an attractive force to draw air between a film F and the temperature controlling member 3 might be reduced.

In contrast, in the present embodiment, respective portions of outer peripheries of the intake duct 66 included in the first contact side-inlet air unit 6*a* contact the film F and the temperature controlling member 3. Further, both sides of the intake duct 66 are covered by respective side covers. Thereby, a space between the film F and the temperature controlling member 3 can be covered by the intake duct 66, upstream of the first contact point 3*a* in a conveying direction. Thus, except for a space between a film F and the temperature controlling member 3, air can be prevented from being drawn.

Additionally, a cross-sectional shape of the intake duct 66 taken along a YZ plane is wedged. Thereby, the inlet port 66*n* of the first contact side-inlet air unit 6*a* can approach the first contact point 3*a*.

In such a manner, reductions in an attractive force to draw the air between the film F and the temperature controlling member 3 is avoided. Thereby, the attractive force can be reliably applied to prevent the air from being interposed between the temperature controlling member 3 and the film F.

In the present embodiment, the intake duct 66 includes a contact layer 68 in a portion in which a film F contacts the outer periphery of the intake duct 66. With the contact layer 68 being used, the film F can be prevented from being unsuccessfully conveyed, due to the film F and the intake duct 66 meeting. Further, the film F can be prevented from being damaged. Additionally, the temperature controlling member 3 can be prevented from rotating unsuccessfully due to the temperature controlling member 3 and the intake duct 66 meeting. The temperature controlling member 3 can be also prevented from being damaged.

In the present embodiment, the width of an inlet port 66*n* of an intake duct 66 is set to be wider than a film F. Thereby, air between a film F and the temperature controlling member 3 can be drawn over the entire width of the first contact point 3*a*. Thus, reductions in adhesion of a film F to the temperature controlling member 3 due to interposition of air can be avoided.

As a film F is being conveyed, the film F may meander in a width direction. Even in such a case of the film F meandering, air between the film F and the temperature controlling member 3 is drawn over the entire width of a first contact point 3*a*. Thereby, reductions in adhesion of a film F to the temperature controlling member 3 due to interposition of air can be avoided.

Note that other effects are the same as effects described in the first embodiment.

Third Embodiment

Figure 15:
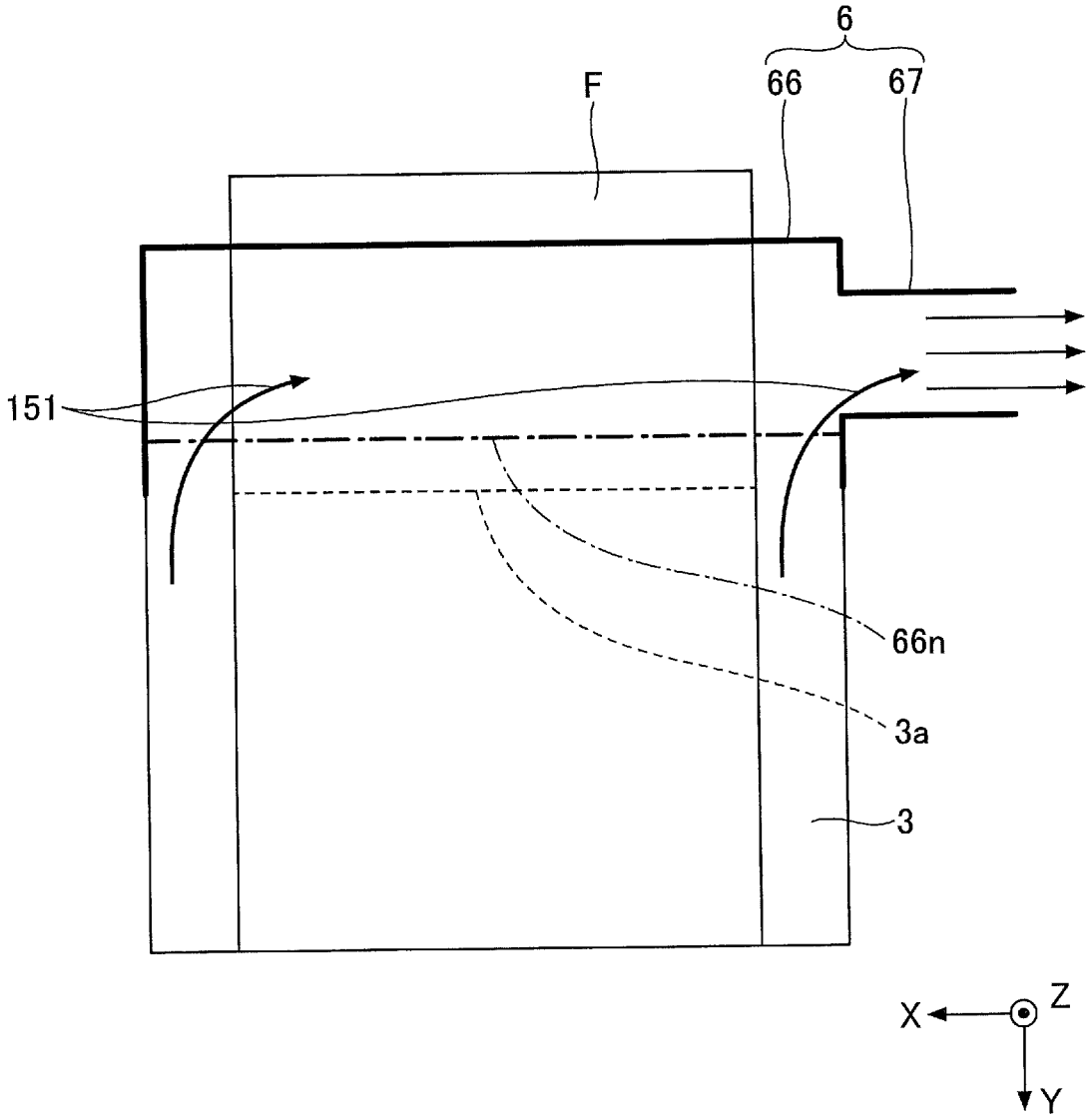
FIG. 15 is a diagram illustrating a configuration of an image forming apparatus according to a comparative example.

Hereafter, an image forming apparatus according to a third embodiment will be described. FIG. 15 is a diagram illustrating a configuration of an image forming apparatus according to a second embodiment as a comparative example of the present embodiment. FIG. 15 is a view of a configuration in the surroundings of a first contact side-inlet air unit 6*a* when viewed from above (a positive Z direction).

In FIG. 15, a dashed line expresses the location of the first contact point 3*a*. A dashed-dotted line expresses the location in which the inlet port 66*n* of the intake duct 66 approaches the first contact point 3*a*. The width of the inlet port 66*n* of the intake duct 66 may be larger than the width of a film F.

In this case, in a portion where the film F is not wrapped in proximity to both end portions of the temperature controlling member 3 in the width direction, except for a space between the temperature controlling member 3 and the film F, air being drawn is increased. In FIG. 15, arrows 151 each indicate the flow of air being drawn in a portion where the film is not wrapped, e.g., except for the space between the temperature controlling member 3 and the film F.

When air is drawn except for a space between the temperature controlling member 3 and a film F, an attractive force caused by a first contact side-inlet air unit 6*a* may be thereby reduced. Further, when a blower having a large air volume is disposed to reliably apply an attractive force, costs of an image forming apparatus may increase as well as power consumption being increased.

Figure 16:
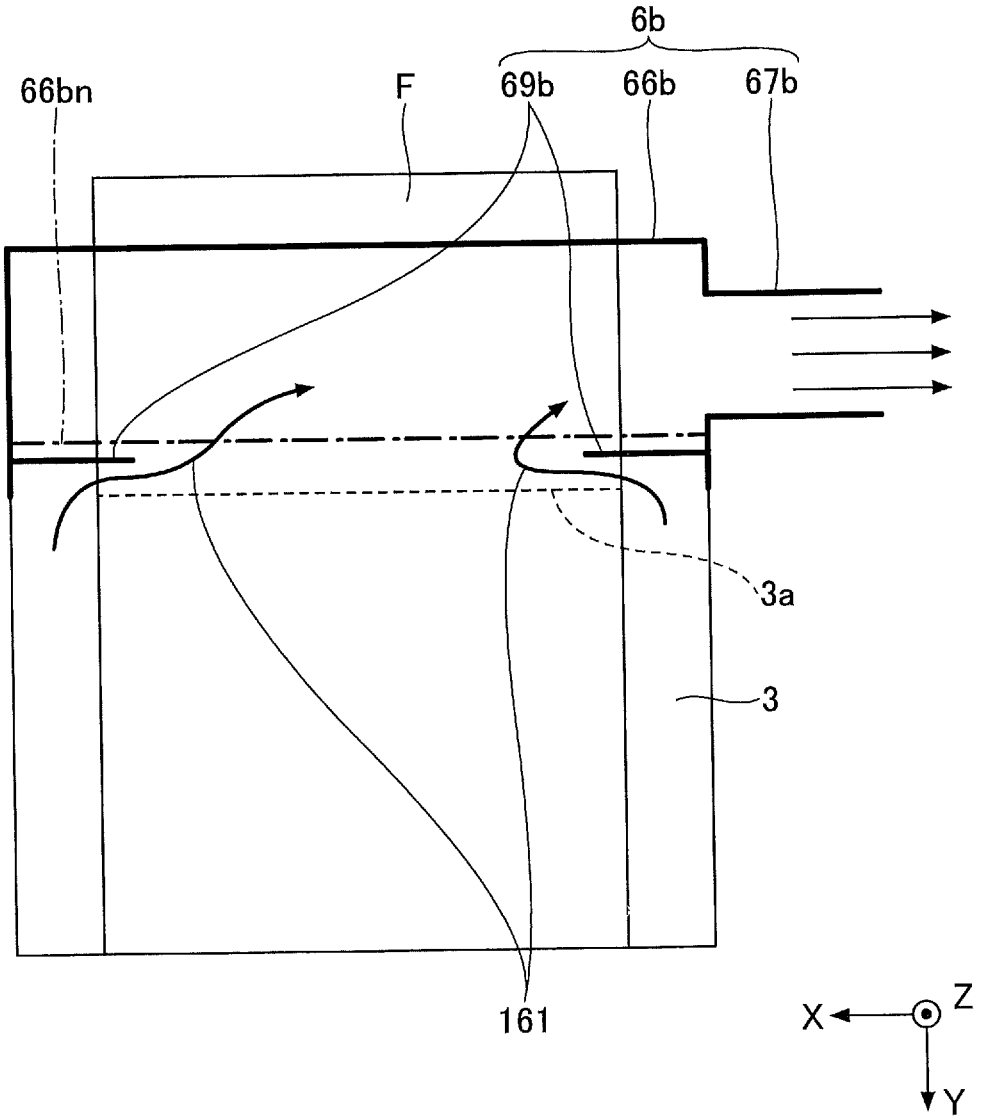
FIG. 16 is a diagram illustrating an example of a configuration of a main part of an image forming apparatus according to a third embodiment.

In light of the point described above, in the present embodiment, as illustrated in FIG. 16, respective control members 69 for controlling drawing of air are disposed on both end portions of an inlet port 66*bn* of the intake duct 66*b* in a width direction, where the inlet port 66*bn* is expressed by a dashed-dotted line.

The control members 69*b* allow air drawn through the inlet port 66*bn* to flow toward the middle of a film F in a width direction, at both end portions of the inlet port 66*bn* in a width direction. Thereby, at both ends of the inlet port 66*bn* in a width direction, air being drawn except for a space between the temperature controlling member 3 and a film F can be reduced. Accordingly, reductions in an attractive force caused by the first-contact side inlet air unit 6*b* can be avoided. Further, an attractive force can be reliably provided without using a blower having a large air volume. Accordingly, increases in costs of an image forming apparatus, as well as increases in power consumption of the image forming apparatus, can be avoided.

Note that other effects are the same as effects described in the first embodiment and the second embodiment.

Fourth Embodiment

Hereafter, an image forming apparatus according to a fourth embodiment will be described.

Figure 17:
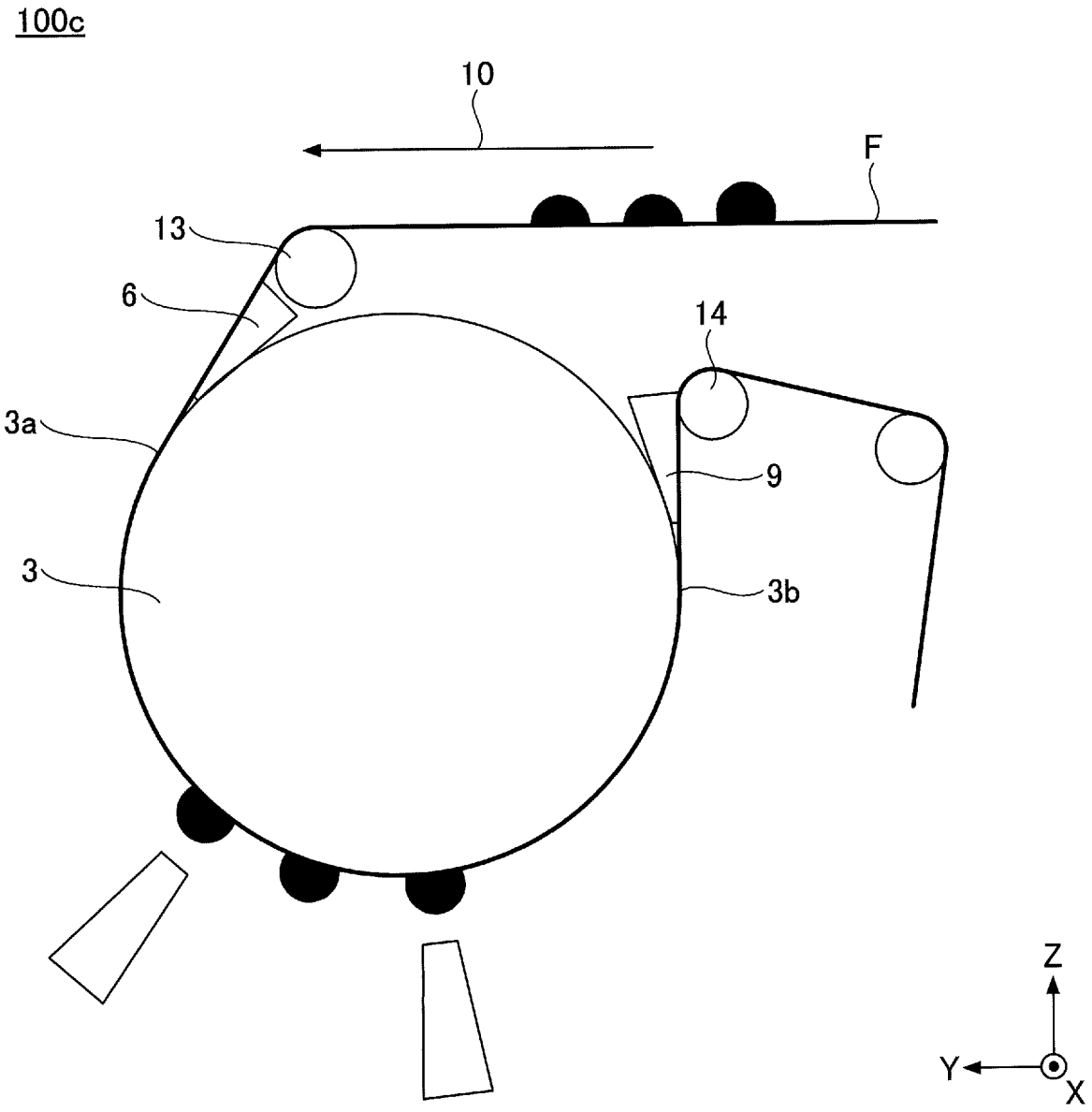
FIG. 17 is a diagram illustrating an example of a configuration of an image forming apparatus according to a fourth embodiment.

FIG. 17 is a diagram illustrating an example of a configuration of the image forming apparatus according to the present embodiment. As illustrated in FIG. 17, an image forming apparatus 100*c* includes a last contact side-inlet air unit 9. The last contact side-inlet air unit 9 is disposed between a conveying roller 14 and a last contact point 3*b*, the conveying roller 14 being disposed downstream of the last contact point 3*b* and in proximity to the last contact point 3*b*. The last contact side-inlet air unit 9 can draw air between a film F and a temperature controlling member 3, upstream of the point 3*b* in which the film F last contacts the temperature controlling member 3, in a conveyance direction.

The last contact side-inlet air unit 9 is an example of an "downstream inlet air unit". The last contact point 3*b* is an example of a "contact location", and the conveying roller 14 is an example of an "downstream supporting member".

In the example illustrated in FIG. 17, a first-contact side inlet air unit 6 includes a nozzle 61, a tube 62, and a blower 63. The last contact side-inlet air unit 9 includes a nozzle 91, a tube 92, and a blower 93. Note that the tube 62, the blower 63, the tube 92, and the blower 93 are not illustrated. The tubes 62 and 92 are not connected to each other and are separate. The blowers 63 and 93 are also separate.

Figure 18:
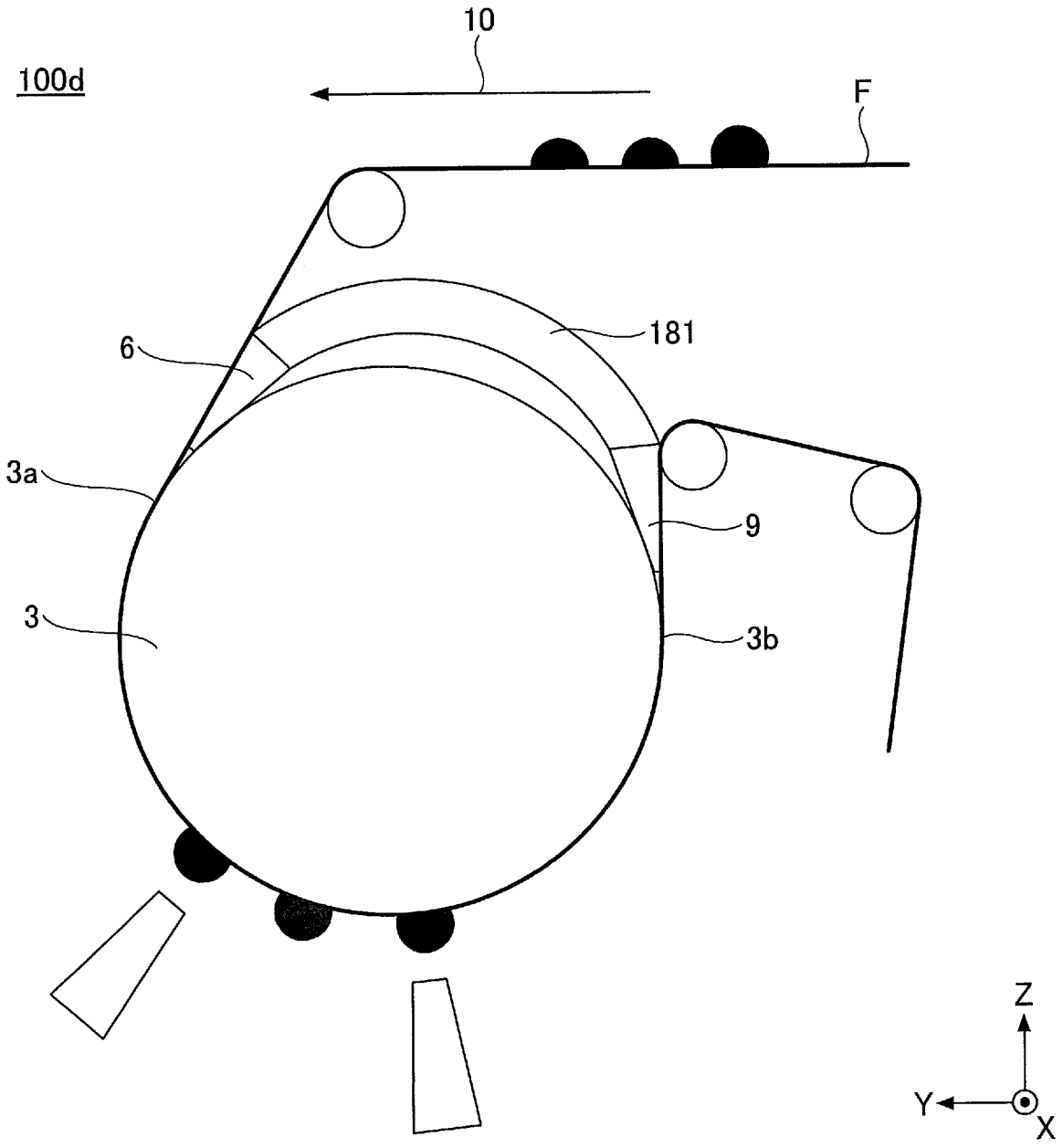
FIG. 18 is a diagram illustrating an example of a configuration of an image forming apparatus according to modification of the fourth embodiment.

FIG. 18 is a diagram illustrating an example of a configuration of an image forming apparatus according to modification of the present embodiment. As illustrated in FIG. 18, an image forming apparatus 100*d* includes a duct hose 181 that connects a first contact side-inlet air unit 6 and a last contact side-inlet air unit 9. One blower not illustrated is connected to the duct hose 181. The blower blows air in a predetermined direction. Thereby, the blower can generate an attractive force to draw air from each of an inlet port of a nozzle 61 and an inlet port of a nozzle 91, through the duct hose 181.

As illustrated in FIGS. 17 and 18, in the present embodiment, air can be drawn between a film F and the temperature controlling member 3, in both locations in which the film F and the temperature controlling member 3 meet first and last. Thereby, adhesion of a film F to the temperature controlling member 3 can be further improved.

Note that other effects are the same as effects described in the first embodiment, the second embodiment, and the third embodiment.

Fifth Embodiment

Hereafter, an image forming apparatus according to a fifth embodiment will be described.

With respect to an image forming apparatus 100*c* described in the fourth embodiment, because a temperature controlling member 3 and a film F are closely disposed, space for a first-contact side inlet air unit 6 or a last contact side-inlet air unit 9 is decreased, and thus arrangement of the first-contact side inlet air unit 6 or the last contact side-inlet air unit 9 might be restricted.

Additionally, if an inlet port of the first-contact side inlet air unit 6 or the last contact side-inlet air unit 9 is not arranged accurately in proximity to a first contact point 3*a*, air between the temperature controlling member 3 and a film F is not be drawn, and thus adhesion of the film F to the temperature controlling member 3 might be unable to be secured. If the adhesion of a film F to the temperature controlling member 3 decreases, drying efficiency by the temperature controlling member 3 might be decreased.

When one or more components including a duct hose 67 of a first contact side-inlet air unit 6 and one or more components of a last contact side-inlet air unit 9, are disposed to bridge side plates of an image forming apparatus, space in proximity to the side plates is occupied by the first contact side-inlet air unit 6 and the last contact side-inlet air unit 9. As a result, other components, wirings, and the like used in controlling an image forming apparatus might not be easily disposed in the space in the surroundings of the side plates. Thus, a configuration of the image forming apparatus or component arrangement might be restricted.

In contrast, in the present embodiment, a first contact side-inlet air unit 6 and a last contact side-inlet air unit 9 are positioned with respect to a shaft core portion 45 of a heating member 40 to be fixed. Thereby, each of the first contact side-inlet air unit 6 and the last contact side-inlet air unit 9 is accurately disposed in a predetermined location and on an outer peripheral surface of a cylindrical unit 46 of a heating member 40. Further, space for a first contact side-inlet air unit 6 and a last contact side-inlet air unit 9 toward respective side plates becomes unnecessary. Restrictions in arrangement of other components, wirings, and the like are suppressed. Thus, restrictions in a configuration of an image forming apparatus, as well as restrictions in arrangement of components, are suppressed.

Figure 19:
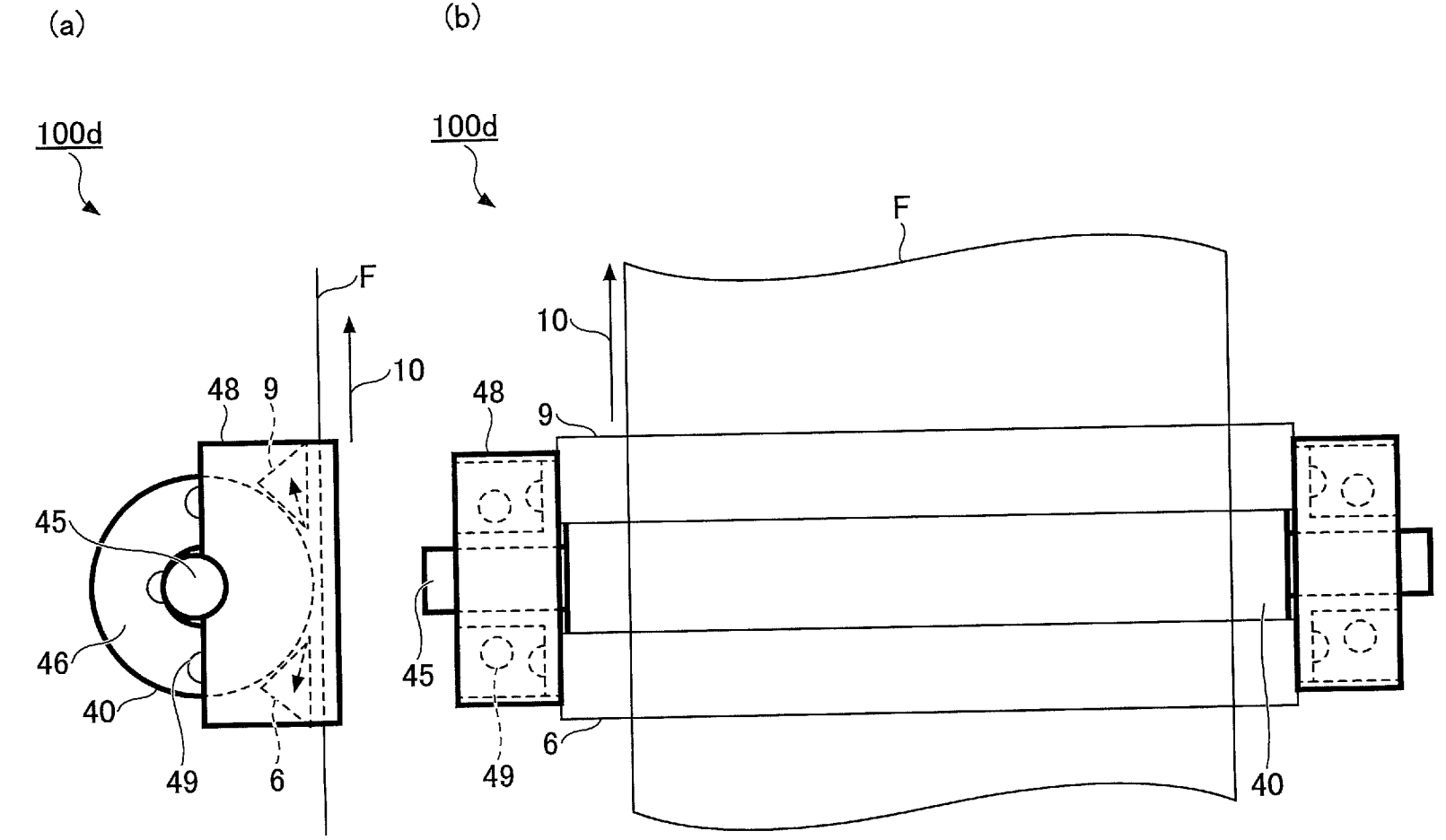
FIG. 19 is a diagram illustrating an example of a configuration of a main part of an image forming apparatus according to a fifth embodiment.

FIG. 19 is a diagram illustrating an example of a configuration of a main part of an image forming apparatus 100*d* according to the present embodiment. As illustrated in FIG. 19, the image forming apparatus 100*d* includes a heating member 40 and a bracket 48 for a shaft core portion, where the bracket 48 is attached to a shaft core portion 45 of the heating member 40. FIG. 19(*a*) is a cross-sectional view of the main part of the image forming apparatus 100*d* when viewed from an axial direction of the heating member 40. FIG. 19(*b*) is a view of the main part of the image forming apparatus 100*d* when viewed from a radial direction of the heating member 40.

A heating member 40 is a rotating member, and includes a heater that allows a film that contacts the outer peripheral surface of the cylindrical portion 46 of the heating member 40 to be heated. The shaft core portion 45 of the heating member 40 does not rotate and is fixed, even when the cylindrical portion 46 of the heating member 40 is rotated. In such a manner, a bracket 48 for a shaft core portion is attached to the shaft core portion 45. Thereby, a stationary bracket 48 for a shaft core portion can be disposed in the surroundings of the heating member 40.

Further, in order to secure accuracy of conveyance, the shaft core portion 45 and the cylindrical portion 46 of the heating member 40 are each coaxially arranged highly accurately. An outer peripheral surface of the cylindrical portion 46 is also highly accurately positioned with respect to the shaft core portion 45. In other words, the shaft core portion 45 is highly accurately positioned in a predetermined location, with reference to an outer peripheral surface of the heating member 40.

In such a manner, the bracket 48 for a shaft core portion is fixed with respect to the shaft core portion 45, and the first contact side-inlet air unit 6 and the last contact side-inlet air unit 9 are each fixed to the bracket 48 for a shaft core portion. Thereby, increases in component variation are avoided. Tip portions of nozzles included in a first contact side-inlet air unit 6 and a last contact side-inlet air unit 9 can be each disposed in a location several hundredths millimeters away from an outer peripheral surface of the cylindrical portion 46 and in proximity to the cylindrical portion 46. Here, the heating member 40 is an example of a "temperature controlling member", and the shaft core portion 45 is an example of a "fixed unit." The shaft core bracket 48 for a shaft core portion is an example of a "holding unit".

As a tip portion of a given nozzle is disposed in proximity to an outer peripheral surface of the cylindrical portion 46, air can be prevented from being drawn, except for a space between a film F and a surface of the heating member 40. Thereby, air is more efficiently drawn from a space between a film F and a surface of the heating member 40 and thus adhesion of the film F to the heating member 40 can be secured. With the adhesion being secured, drying efficiency is improved, as well as reduction of puckering, etc. of the film F may be improved.

Further, when a bracket 48 for a shaft core portion is attached to the shaft core portion 45, restrictions in arrangement of other components, wirings, and the like toward side plates are suppressed because a first contact side-inlet air unit 6 and a last contact side-inlet air unit 9 are not required to be mounted to respective side plates of the image forming apparatus 100*d*. Accordingly, a restrictions in a configuration of the image forming apparatus 100*d*, as well as restrictions in arrangement of components, can be suppressed.

Note that, for positioning and fixing of a first contact side-inlet air unit 6 and a last contact side-inlet air unit 9 in a direction in which the heating member 40 is rotated, a measuring instrument such as a gap gauge can be used to perform positioning to fix a bracket 48 for a shaft core portion to a shaft core portion 45, by screw portions 49.

In a configuration of the image forming apparatus 100*d*, in order to mount a first contact side-inlet air unit 6 and a last contact side-inlet air unit 9, because holes or the like are not required to be formed in side plates of the image forming apparatus 100*d*, the first contact side-inlet air unit 6 and the last contact side-inlet air unit 9 can be provided later in an existing image forming apparatus in which a first contact side-inlet air unit 6 and a last contact side-inlet air unit 9 are not provided. In this case, a unit including a first contact side-inlet air unit 6 and a last contact side-inlet air unit 9 can be provided on an optional unit to add functionality to an existing image forming apparatus.

Figure 20:
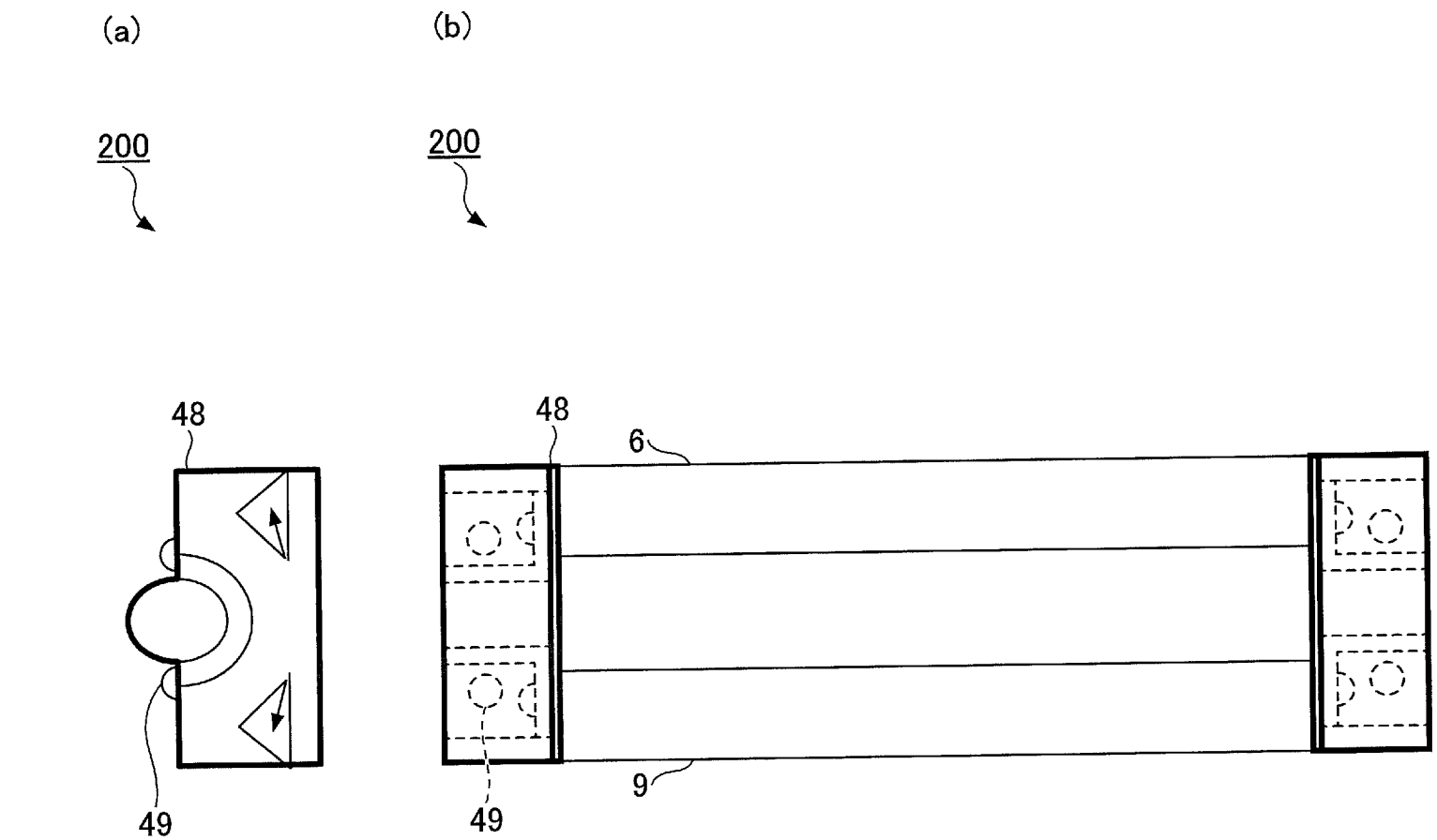
FIG. 20 is a diagram illustrating an example of a configuration of an optional unit.

FIG. 20 is a diagram illustrating an example of a configuration of the above optional unit. FIG. 20(*a*) is a cross-sectional view of the optional unit 200 when viewed from an axial direction of the optional unit. FIG. 20(*b*) is a view of the optional unit 200 when viewed from a radial direction of the optional unit 200. The optional unit 200 includes a first contact side-inlet air unit 6; a last contact side-inlet air unit 9; a bracket 48 for a shaft core portion; and screw portions 49. The optional unit 200 can be positioned to be fixed using screw portions 49, where the bracket 48 for a shaft core portion is attached to a shaft core portion of a heating member included in an existing image forming apparatus in which a first contact side-inlet air unit 6 and a last contact side-inlet air unit 9 are not included. Further, when the screw portions 49 are loosened, the optional unit 200 can be removed from the above shaft core portion. In other words, the option unit 200 is detachable from a given shaft core portion. The optional unit 200 is an example of an "inlet air unit".

As described above, the optional unit 200 can be lately added to highly accurately dispose a first contact side-inlet air unit 6 and a last contact side-inlet air unit 9, in the outer periphery of a cylindrical portion of a heating member.

Note that other effects in the present embodiment are the same as effects described in the above embodiments.

Sixth Embodiment

Hereafter, an image forming apparatus according to a sixth embodiment will be described.

In the present embodiment, a first contact side-inlet air unit 6 and a last contact side-inlet air unit 9 are integrated to form a single dual inlet air unit, thereby further saving space.

Figure 21:
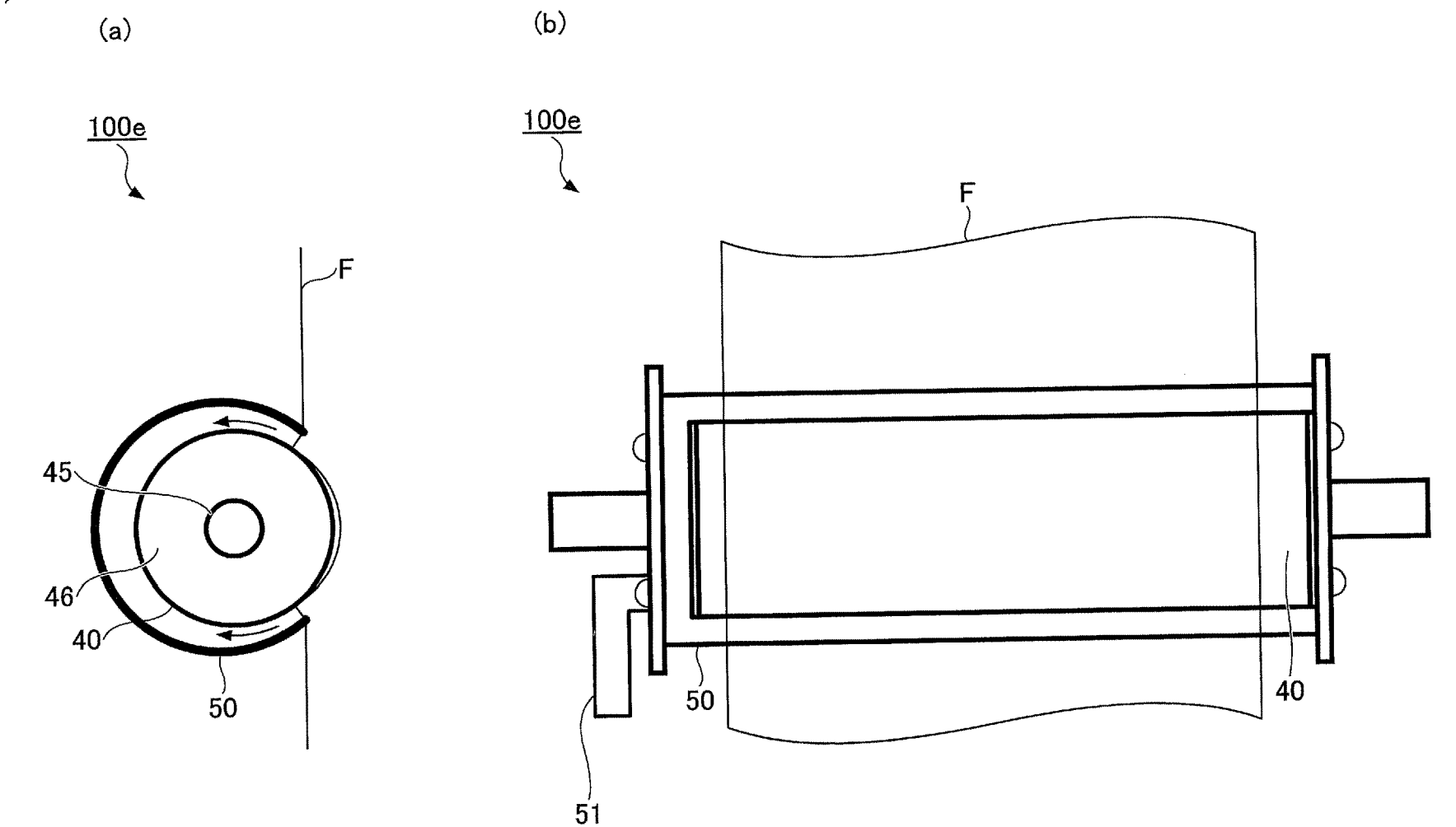
FIG. 21 is a diagram illustrating an example of a configuration of a main part of an image forming apparatus according to a sixth embodiment, where (a) is a view of the main part of the image forming apparatus when viewed from an axial direction of a heating member; and (b) is a view of the main part of the image forming apparatus when viewed from a radial direction of the heating member.

FIG. 21 is a diagram illustrating an example of a configuration of a main part of an image forming apparatus 100*e* according to the present embodiment. FIG. 21(*a*) is a cross-sectional view of the main part of the image forming apparatus 100*e* when viewed from an axial direction of a heating member 40. FIG. 21(*b*) is a view of the main part of the image forming apparatus 100*e* when viewed from a radial direction of the heating member 40.

As illustrated in FIG. 21, the image forming apparatus 100*e* includes a dual inlet air unit 50 and a duct 51. As illustrated in FIG. 21(*a*), the dual inlet air unit 50 is formed to have a cylindrical shape from which a cylindrical portion is partially removed. The heating member 40 can be partially disposed within a cylinder. The heating member 40 is partially disposed within the dual inlet air unit 50, where both ends of a removed cylindrical portion of the dual inlet air unit 50 are in proximity to the outer periphery of a cylindrical portion 46 of the heating member 40. In such a manner, air within the dual inlet air unit 50 is drawn through the duct 51. Thereby, air flows as indicated by arrows in FIG. 21(*a*), and such an air flow allows air between a film F and the heating member 40 to be drawn.

In such a configuration, functions of a first contact side-inlet air unit 6 and a last contact side-inlet air unit 9 can be achieved by a single dual inlet air unit 50. Thereby, an inlet air unit can be simplified. Further, the heater member 40 is partially disposed within the dual inlet air unit 50 to be covered by the dual inlet air unit 50. In this case, the entire inner surface of the dual inlet air unit 50 can be in proximity to the entire outer peripheral surface of the cylindrical portion 46 of the heater member 40. Thereby, unwanted air does not flow, and thus air between a film F and the heating member 40 can be efficiently drawn.

Note that other effects are the same as effects described in the above embodiments.

Seventh Embodiment

Hereafter, an image forming apparatus according to a seventh embodiment will be described.

In the present embodiment, a plurality of heating members are arranged in a coil pattern to increase a length of a dry path. Thereby, drying is efficiently performed in limited dry space. Further, dual inlet air units 50 (see FIG. 21) described in the sixth embodiment are each provided for a corresponding heating member from among the plurality of heating members, which are disposed in a coil pattern. Thereby, adhesion of a film to each heating member is secured, and thus drying efficiency through the heating members is improved. The length of the dry path refers to a distance conveyed by a film, to dry ink applied to the film.

Figure 22:
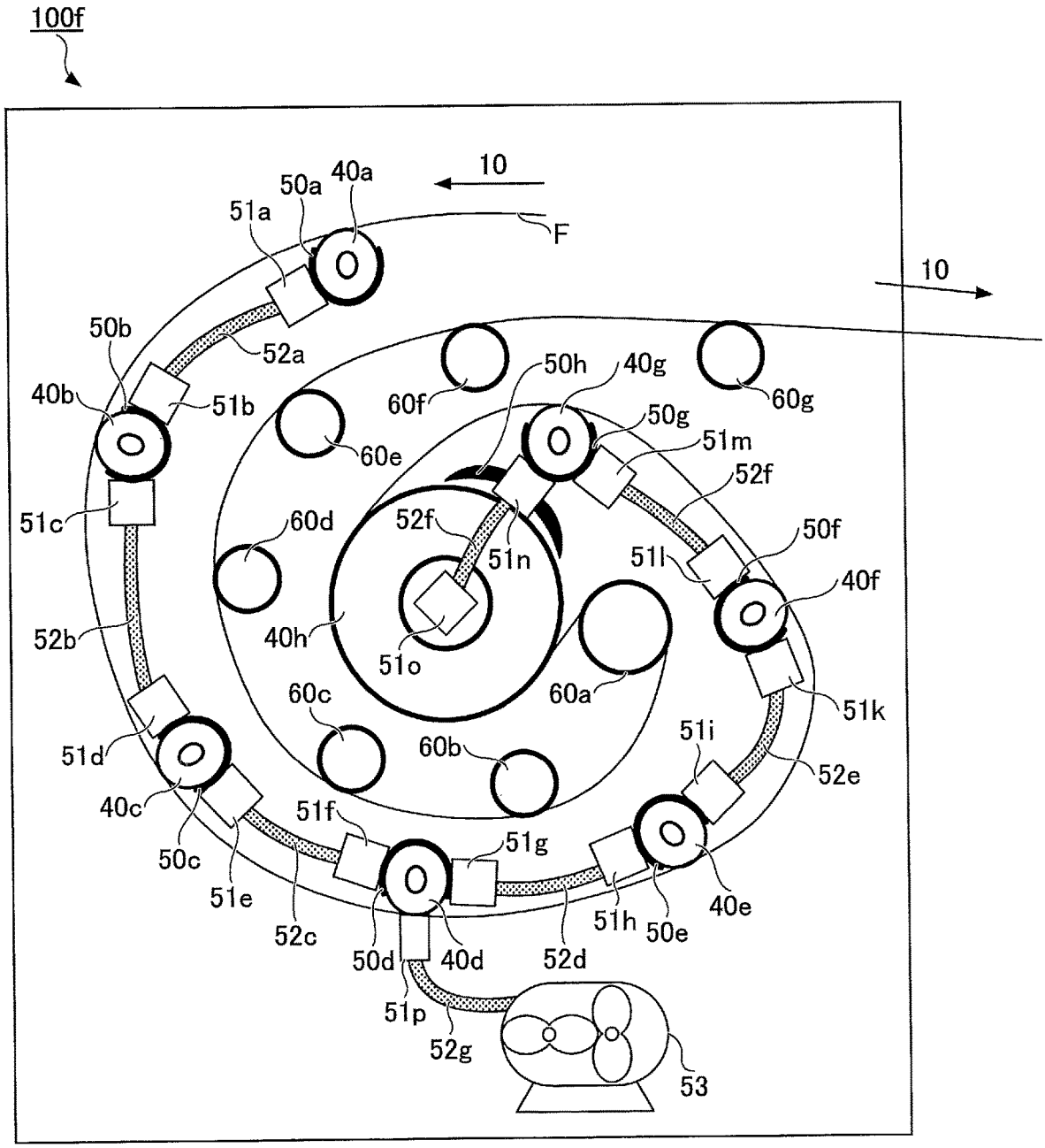
FIG. 22 is a diagram illustrating an example of a configuration of a main part of an image forming apparatus according to a seventh embodiment.

FIG. 22 is a diagram illustrating an example of a configuration of a main part of an image forming apparatus 100*f* according to the present embodiment. As illustrated in FIG. 22, the image forming apparatus 100*f* includes a plurality of heating members 40*a* to 40*h*; a plurality of dual inlet air units 50*a* to 50*h*; a plurality of conveying rollers 60*a* to 60*g*; a plurality of ducts 51*a* to 51*o*; a plurality of hoses 52*a* to 52*f*; and a blower 53.

The plurality of heating members 40*a* to 40*h* are arranged in a coil pattern, each heating member having a configuration and function that are the same as the configuration and function of the heating member 40 described in the fifth embodiment and the sixth embodiment. However, only the heating member 40*h*, which is disposed in the center of the coil, has a diameter greater than a diameter of each of the heating members 40*a* to 40*g*.

A film F, which contacts an outer peripheral surface of a cylindrical surface of each of the heating members 40*a* to 40*h* to be heated, is conveyed along a conveyance direction 10. The film F contacts each of the rollers 60*a* to 60*g* to be conveyed, upstream of the heating member 40*h* in a conveying direction.

The dual inlet air units 50*a* to 50*h* are each provided for a corresponding heater from the plurality of heating members 40*a* to 40*h*, each dual inlet air unit being partially disposed within a given cylinder. Each of the dual inlet air units 50*a* to 50*h* has the same configuration and function as the heating member 40 described in the sixth embodiment.

The plurality of ducts 51*a* to 510 are each provided to draw air within a given dual inlet air unit 50, as is the case with the duct 51 described in the sixth embodiment.

The plurality of hoses 52*a* to 52*f* are examples of a "pipe" for connecting adjacent ducts to allow air to flow between the ducts. Adjacent two inlet air units are connected to one hose, and both ends of the hose are respectively connected to two ducts. The adjacent two inlet air units are connected through two ducts and one hose to allow air to flow between the two inlet air units.

Additionally, for all two unit pairs each having adjacent dual inlet air units, the adjacent dual inlet air units are connected to each other through two ducts and one hose. Thereby, all dual inlet air units 50*a* to 50*h* allows for an air flow among the dual inlet air units.

The blower 53 is a device for generating an Attractive force of air, and is connected to the dual inlet air unit 50*d* through a duct 51*p* and a hose 52*g*. Because all of the dual inlet air units 50*a* to 50*h* allow for an air flow among the dual inlet air units, each of the dual inlet air units 50*a* to 50*h* allows air to be drawn through an attractive force generated by the blower 53, via the dual inlet air unit 50*d*. The blower 53 is an example of an "attractive-force generating unit."

<Effect of Image Forming Apparatus 100*f*>

As described above, in the present embodiment, a plurality of heating members 40*a* to 40*h* are arranged in a coil pattern. Thereby, a length of a dry path is increased, and thus drying can be efficiently performed in limited dry space.

In the present embodiment, a plurality of dual inlet air units 50*a* to 50*h* are each provided for a corresponding heating member from among a plurality of heating members 40*a* to 40*h* to draw air between each of the heating members 40*a* to 40*h* and a film F. Thereby, adhesion of a film F to each of the heating members 40*a* to 40*h* can be secured. Further, the adhesion can be secured and thus drying efficiency can be further improved. Accordingly, puckering of a film F can be avoided.

In the present embodiment, all of the dual inlet air units 50*a* to 50*h* allow for an air flow among the dual inlet air units. In this case, an attractive force generated by one blower 53 is applied to allow air to be drawn through all of the dual inlet air units 50*a* to 50*h*. Thereby, the number of blowers is reduced and thus a device configuration is simplified as well as being able to save space for component arrangement.

Further, hoses 52*a* to 52*f* or the like do not interrupt a conveyance path of a film F. Thus, a maintenance worker can easily access a film F in maintenance work for allowing for smooth conveyance of a film F. Thereby, maintenance workability can be improved.

Hereafter, a further effect of the image forming apparatus 100*f* will be described with reference to FIGS. 23 and 24.

Figure 23:
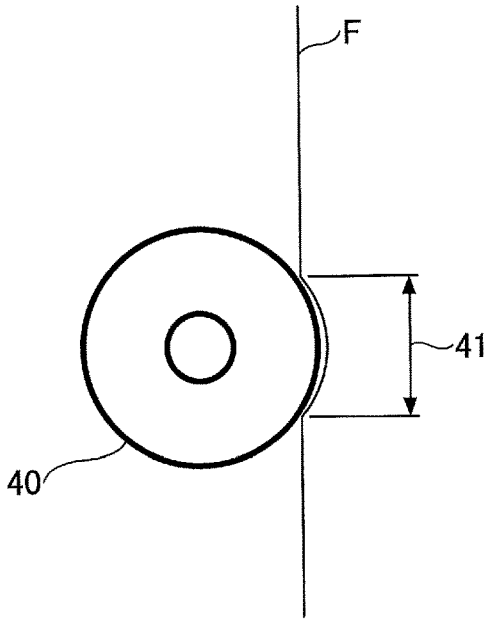
FIG. 23 is a diagram illustrating a contact state of a film with a heating member according to the comparative example.
Figure 24:
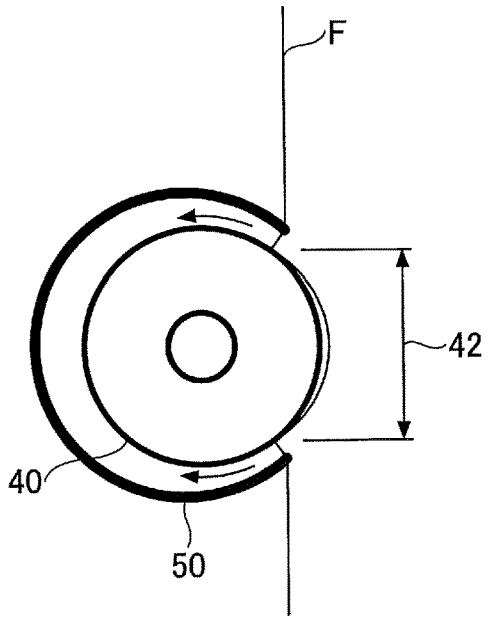
FIG. 24 is a diagram illustrating an example of a contact state of a film with a heating member according to the embodiment.

FIG. 23 is a diagram illustrating a state in which a heating member and a film meet according to a comparative example. The film is heated in accordance with thermal conduction across a portion where the film is wrapped around a heating member to contact the heating member, and thus drying of the film is facilitated. A contact portion 41 indicates a portion where a film is wrapped around a heating member to contact the heating member.

In general, when an image forming apparatus includes a plurality of heating members 40*a* to 40*h*, an amount of a film F being wrapped around each heating member is decreased and thus a contact portion 41 is decreased (shortened). Accordingly, drying efficiency through each heating member is decreased.

In contrast, an image forming apparatus 100*f* includes a plurality of dual inlet air units 50*a* to 50*h* each provided for a corresponding heating member from among a plurality of heating members 40*a* to 40*h*. When the dual inlet air units 50*a* to 50*h* are disposed to draw air, a film F is attracted to each heating member. In this case, as illustrated in FIG. 24, a contact portion 42 of a film F with a given heating member is longer than the contact portion 41 in FIG. 23. With the above contact portion being longer, heating efficiency is increased and thus drying efficiency is increased.

As described above, according to the present embodiment, a plurality of heating members 40*a* to 40*h* are arranged in a coil pattern to allow a length of a dry path to be increased. Thereby, space is saved as well as drying efficiency being increased. Further, a contact portion of a film F with each heating member is increased in length in accordance with each of the dual inlet air units 50*a* to 50*h* drawing air. Accordingly, drying efficiency can be further improved.

Note that other effects are the same as the effects described in the above embodiments.

The embodiments have been described above. However, the present disclosure is not limited to the embodiments specifically disclosure, and various modifications and changes can be made without departing from a scope of the claims.

What is claimed is:

1. An apparatus comprising:

a temperature controlling member configured to heat or cool a conveyed substrate to which a liquid is applied, the conveyed substrate contacting an outer peripheral surface of the temperature controlling member; and an upstream inlet air unit configured to draw air between the substrate and the temperature controlling member, the upstream inlet air unit being provided upstream of a contact location of the substrate with the temperature controlling member, in a conveying direction, wherein the upstream inlet air unit includes an intake duct that covers a space between the substrate and the temperature controlling member, upstream of the contact location in the conveying direction, wherein the substrate and the temperature controlling member is configured to contact respective portions of outer peripheries of the intake duct, and wherein the intake duct includes a contact layer at a position where a given outer periphery of the intake duct contacts the substrate, the contact layer having a friction coefficient against the substrate that is smaller than a friction coefficient of the intake duct against the substrate.

2. The apparatus according to claim 1, further comprising an upstream support member disposed upstream of the contact location in the conveying direction and in proximity to the upstream inlet air unit, and wherein the upstream inlet air unit is disposed between the upstream support member and the contact location.

3. The apparatus according to claim 1, wherein the intake duct includes an inlet port for drawing air between the substrate and the temperature controlling member, and wherein a width of the inlet port in a width direction perpendicular to the conveying direction of the substrate is larger than a width of the substrate.

4. The apparatus according to claim 1, further comprising a downstream inlet air unit configured to draw air between the substrate and the temperature controlling member, the downstream inlet air unit being provided downstream of the contact location in the conveying direction.

5. The apparatus according to claim 4, wherein the temperature controlling member includes a fixed unit disposed in a predetermined location, with reference to the outer peripheral surface of the temperature controlling member, and wherein at least one among the upstream inlet air unit and the downstream inlet air unit is fixed with respect to the fixed unit.

6. The apparatus according to claim 4, further comprising a dual inlet air unit configured to draw air between the substrate and the temperature controlling member, upstream of the contact location in the conveying direction and downstream of the contact location in the conveying direction.

7. The apparatus according to claim 6, wherein the temperature controlling member includes a fixed unit disposed in a predetermined location, with reference to the outer peripheral surface of the temperature controlling member, and wherein the dual inlet air unit is fixed with respect to the fixed unit.

8. The apparatus according to claim 4, further comprising a plurality of dual inlet air units configured to draw air between the substrate and the temperature controlling member, each dual inlet air unit being provided upstream of the contact location in the conveying direction and downstream of the contact location in the conveying direction.

9. The apparatus according to claim 8, further comprising an attractive force-generating unit configured to generate an attractive force to draw air, and wherein each of the plurality of inlet air units is connected to a pipe to allow air to flow into a given inlet air unit from among the inlet air units, each inlet air unit being configured to draw the air by the attractive force.

10. A liquid discharging apparatus comprising:

a liquid applying unit configured to apply a liquid to a substrate; and the apparatus according to claim 1.

11. An apparatus, comprising:

a temperature controlling member configured to heat or cool a conveyed substrate to which a liquid is applied, the conveyed substrate contacting an outer peripheral surface of the temperature controlling member; and an upstream inlet air unit configured to draw air between the substrate and the temperature controlling member, the upstream inlet air unit being provided upstream of a contact location of the substrate with the temperature controlling member, in a conveying direction, wherein the upstream inlet air unit includes an intake duct that covers a space between the substrate and the temperature controlling member, upstream of the contact location in the conveying direction, wherein the substrate and the temperature controlling member is configured to contact respective portions of outer peripheries of the intake duct, wherein the intake duct includes an inlet port for drawing air between the substrate and the temperature controlling member, wherein a width of the inlet port in a width direction perpendicular to the conveying direction of the substrate is larger than a width of the substrate, and wherein the upstream inlet air unit includes respective control members at both sides of the inlet port in the width direction, each control member being configured to control air being drawn through the inlet port.

12. The apparatus according to claim 11, further comprising a downstream support member disposed downstream of the contact location in the conveying direction and in proximity to the downstream inlet air unit, and wherein the downstream inlet air unit is disposed between the downstream support member and the contact location.

13. An inlet air unit for releasably being held by an apparatus, the inlet air unit comprising:

a fixed unit disposed in a predetermined location, with reference to an outer peripheral surface of a given temperature controlling member from among a plurality of temperature controlling members of an apparatus, each temperature controlling member being configured to heat or cool a conveyed substrate to which a liquid is applied, the conveyed substrate contacting the outer peripheral surface of the given temperature controlling member;

at least one from among an upstream air inlet unit and a downstream air inlet unit, the upstream inlet air unit being configured to draw air between the substrate and the given temperature controlling member, the upstream inlet air unit being provided upstream of a contact location of the substrate with the given temperature controlling member, in a conveying direction, the downstream inlet air unit being configured to draw air between the substrate and the given temperature controlling member, the downstream inlet air unit being provided downstream of the contact location in the conveying direction; and a holding unit configured to hold the at least one from among the upstream air inlet unit and the downstream air inlet unit, the holding unit being configured to be detached from the fixed unit, wherein the upstream inlet air unit includes an intake duct that covers a space between the substrate and the temperature controlling member, upstream of the contact location in the conveying direction, wherein the substrate and the temperature controlling member is configured to contact respective portions of outer peripheries of the intake duct, wherein the intake duct includes an inlet port for drawing air between the substrate and the temperature controlling member, wherein a width of the inlet port in a width direction perpendicular to the conveying direction of the substrate is larger than a width of the substrate, wherein the upstream inlet air unit includes respective control members at both sides of the inlet port in the width direction, each control member being configured to control air being drawn through the inlet port, and wherein the downstream inlet air unit is disposed between a downstream support member and the contact location, the downstream support member being disposed downstream of the contact location in the conveying direction and in proximity to the downstream inlet air unit.

* * * * *